US008647244B2

(12) United States Patent
Wyeroski

(10) Patent No.: US 8,647,244 B2
(45) **Date of Patent: *Feb. 11, 2014**

(54) EXERCISE MACHINE

(76) Inventor: James Ronald Wyeroski, Newfoundland, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/195,104

(22) Filed: Aug. 1, 2011

(65) Prior Publication Data

US 2011/0281698 A1 Nov. 17, 2011

Related U.S. Application Data

(63) Continuation of application No. 12/798,694, filed on Apr. 9, 2010, now Pat. No. 7,988,605.

(60) Provisional application No. 61/217,775, filed on Jun. 4, 2009.

(51) Int. Cl.
*A63B 21/015* (2006.01)

(52) U.S. Cl.
USPC ..... 482/118; 482/115; 482/116

(58) Field of Classification Search
USPC ..... 482/1, 51, 70, 72, 114–121, 127; 273/317.6–317.9, 329–330; 473/142, 473/423, 431; 242/373, 375; 119/796; 280/807
IPC ..... A63B 21/012,21/015, 21/018
See application file for complete search history.

(56) References Cited

U.S. PATENT DOCUMENTS

| | | | | |
|---|---|---|---|---|
| 2,817,524 | A * | 12/1957 | Sadler | 482/117 |
| 4,114,874 | A | 9/1978 | Mattila | |
| 4,576,372 | A | 3/1986 | Rinaldi | |
| 4,611,807 | A | 9/1986 | Castillo | |
| 4,871,165 | A | 10/1989 | Marshall et al. | |
| 5,876,310 | A | 3/1999 | Mackey et al. | |
| 6,482,138 | B1 * | 11/2002 | Nelson | 482/118 |
| 6,770,014 | B2 | 8/2004 | Amore | |
| 6,837,830 | B2 | 1/2005 | Eldridge | |
| 6,929,589 | B1 | 8/2005 | Bruggemann et al. | |
| 7,775,936 | B2 | 8/2010 | Wilkinson | |
| 2003/0087735 | A1 * | 5/2003 | Chen | 482/116 |
| 2008/0076644 | A1 | 3/2008 | Rutherford | |
| 2010/0204023 | A1 | 8/2010 | Mills et al. | |

* cited by examiner

*Primary Examiner* — Oren Ginsberg
(74) *Attorney, Agent, or Firm* — The Webb Law Firm

(57) ABSTRACT

An exercise apparatus includes a disk rotatable in first and second directions against a frictional force and a device disposed between a cable and the disk. The device is responsive to tensioning and movement of the cable in the first direction for coupling the cable to the disk whereupon the disk rotates against the frictional force with movement of the cable in the first direction. The device is also responsive to release of the tension in the cable in the first direction for uncoupling the cable from the disk. A rewind arm coupled between the disk and the device is also responsive to the release of the tension in the cable in the first direction for tensioning and moving the cable and the device in the second direction.

17 Claims, 18 Drawing Sheets

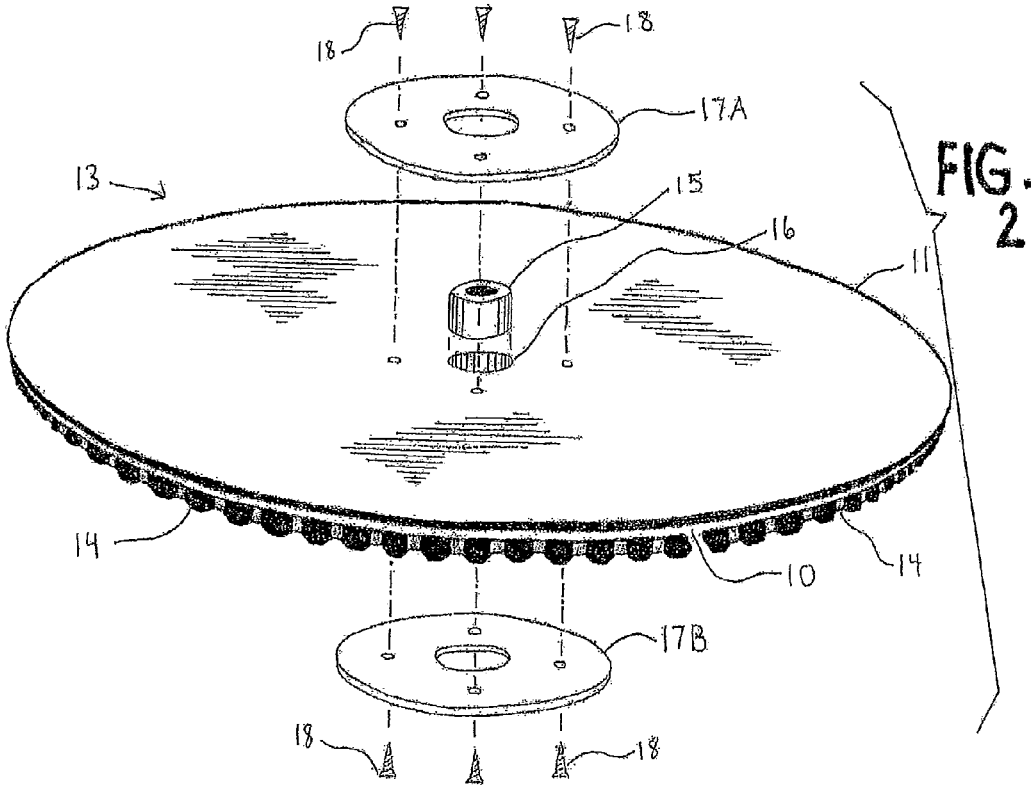
FIG. 2
FIG. 3
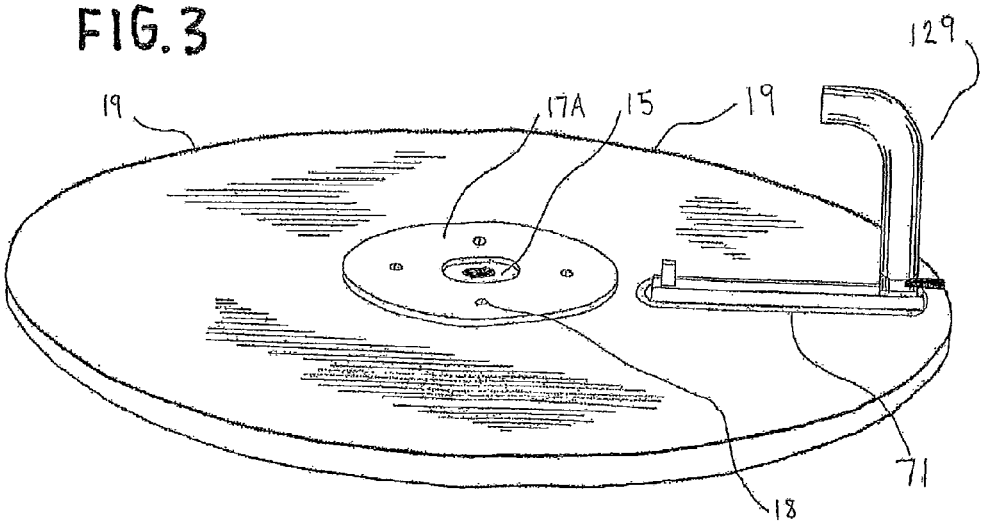

EXERCISE MACHINE

CROSS-REFERENCE TO RELATED APPLICATIONS

This application is a continuation of U.S. patent application Ser. No. 12/798,694, filed Apr. 9, 2010, now U.S. Pat. No. 7,988,605, which claims the benefit of U.S. provisional patent application No. 61/217,775, filed on Jun. 4, 2009, both of which are incorporated herein by reference.

BACKGROUND OF THE INVENTION

There has been a wide variety of different types of resistance exercise equipment developed in the past, for both the professional and consumer markets. These resistance exercise machines have incorporated weights, deformable resistance elements, or friction mechanisms to provide a resistive force. Resistive exercise machines that use weights, tend to be cumbersome and are potentially dangerous to use. Resistance exercise machines that use deformable elements like metal springs, elastic rubber or bow rods, are unnatural and difficult to exercise with, in that, the amount of the tension being applied progressively increases through the positive or forward motion of the exercise. This built up tension exerts a forceful pull back reaction at the beginning of the negative or backward motion of the exercise, which tends to be stressful and unhealthy for your muscles. Resistance exercise machines that use friction mechanisms, usually aren't very versatile in that, they're limited to the amount of different types of exercises they can provide.

There's a need for a versatile motion simulator resistance exercise machine. Which, can safely apply a uniform resistive force to only the forward motion of most bodily exercises, motions or actions. For instance, the forward motion of: a pitching or throwing motion; a punching motion; a backhand in tennis motion; a kicking motion; an arm curl motion; and hundreds of other bodily, therapeutic, or sports like exercises, motions or actions. Which, would make it an extremely efficient and user friendly exercise machine the whole family could use, and an important tool for the sports, physical fitness, and medical industries.

Typically, most of the resistance exercise equipment that's available today, apply a resistive force in only one direction throughout the full range of motion. There's a need for a resistance exercise machine that can apply a resistive force in only one direction coming from two separate sources, alternately. So the user can perform complex two-way or push-then-pull exercises, which are more aerobic and efficient for the avid user.

There's only a few resistance exercise machines available, where the user can exercise their arms or legs in a circular motion. They only provide a few positions in which to exercise in and they're usually on a vertical plane. There's a need for a resistance exercise machine that will enable the user to exercise their arms or legs in a circular motion at any angle in relation to the user.

It's known that personnel stationed in a low gravitational environment as on a space station, tend to lose muscle mass and bone density quickly because of the absence of gravity opposing their movements, and the lack of proper resistance exercise equipment needed to help reduce this loss. There's a need for innovative resistance exercise equipment which can effectively work in a low gravitational environment and safely apply a resistive force to virtually any bodily motion or action. Enabling the user to exercise the essential therapeutic exercises necessary to help counteract muscular atrophy and the loss of bone density. The frame can be designed to fold away into the fuselage of a spacecraft, or the wall, floor or ceiling of a moon or Mars base.

SUMMARY OF THE INVENTION

The present resistance exercise machine can apply a frictional resistive force to any one of three different exercise methods or techniques. They include, the motion simulation technique, the push-then-pull technique, and the full range or circular motion technique.

The motion simulation technique, requires using a detachable accessory like a hand grip or ankle strap, which can be attached to the free end of a flexible accessory cable. Depending on the type of exercise being performed, the accessory cable can be routed through one, or through a variety of different pulleys, to then rest in a channel situated on the periphery of the resistance disk assembly. Lastly, the tail end of the accessory cable is attached to a pawl, mounted to pivot on the outermost end of the rewind arm assembly.

To perform a motion simulation exercise, the user can pull against an accessory cable using an accessory. Which, urges the pawl mechanism of the rewind arm assembly, to pivot inward and engage a complementary shaped gear situated on the periphery of the resistance disk assembly. This forces both, the resistance disk assembly and the newly engaged rewind arm assembly to rotate in unison about a mounted non-rotative spindle as the user pulls against the accessory cable. When the user stops pulling against the accessory cable, the resistance disk assembly immediately stops rotating. Then the spring loaded pawl pivots outward and disengages the gear on the periphery of the resistance disk assembly. Instantaneously, the rewind arm assembly starts to rewind back around the stopped resistance disk assembly by means of a coil spring. Which pulls the accessory cable that has been unwound from the channel, back into the channel situated on the periphery of the resistance disk assembly, in preparation for another pull. Exercising with the motion simulation technique, can strengthen the specific muscles or muscle groups used to perform a particular sports, therapeutic or exercise motion or action safely. Without the pulling back reaction one encounters during the backward motion of an exercise, which is common with most other resistance exercise equipment.

The push-then-pull technique, basically works in the same manner as the motion simulation technique, except the push-then-pull technique requires using two separate resistance disk assemblies alternately, which are controlled by just one accessory. For example, resistance disk assembly #1 applies a resistive force during the pushing motion, as the accessory cable of resistance disk assembly #2 is being pulled back into a channel situated on it's periphery by the rewind arm assembly through the duration of the pushing motion. Then, as the user starts the pulling motion, resistance disk assembly #2 applies the resistive force, as the accessory cable of resistance disk assembly #1 is being pulled back into a channel situated on it's periphery by it's rewind arm assembly.

The circular motion technique, requires rotating an exercise resistance disk using any one of a variety of detachable accessories, like a handle grip or foot pedal. The exercise resistance disk is mounted to a universal frame assembly that's also height adjustable. Enabling the user to exercise in a circular motion at any angle in relation to the user. The exercise resistance disks can be rotated in a clockwise or counterclockwise direction while the user is either standing, sitting or lying down. Exercising in a circular motion, automatically coordinates many smaller one directional exercises into a complex multi-directional exercise. Which, strengthens many muscles or muscle groups at the same time.

The motion simulation, push-then-pull, and circular motion techniques all utilize the same type of frictional resistance. Which is created from tension produced at the center portion of the resistance disk assembly, or the exercise resistance disk by means of a pressure plate and brake disk arrangement. In operation, the pressure plates mounted to the rotating disk are in frictional contact with the non-rotative brake disks, causing drag. The tensional pressure between the pressure plates and brake disks can be varied by turning a threaded tension knob.

More specifically, the invention is an exercise apparatus comprising: a resistance disk including an aperture for receiving a non-rotative spindle therethrough for rotation of the resistance disk on the non-rotative spindle; and a pair of brake disk pads mounted on opposite sides of the resistance disk and coupled to the spindle for non-rotation therewith when the spindle is received in the resistance disk aperture such that the pair of brake disk pads frictionally oppose rotation of the resistance disk on the spindle.

A pair of pressure plates can be fixedly mounted on opposite sides of the resistance disk between the pair of brake disk pads. A bushing can be fixedly mounted in the resistance disk aperture for rotation of the bushing and the resistance disk about the non-rotative spindle disposed in an aperture of the bushing. The pair of brake disk pads can be mounted between a pair of brake disks coupled to the brake disk pads and to the spindle when the spindle is received in the resistance disk aperture.

A tension assembly can be coupled between the spindle and the resistance disk and operative for increasing or decreasing a frictional force applied by the brake disk pads to the resistance disk. The tension assembly can include a spring mounted between the spindle and the resistance disk, and a knob for adjusting the frictional force that the spring causes the brake disk pads to apply to the resistance disk. A handle can be coupled to the resistance disk. Means can be provided for adjusting a position of the handle on the resistance disk.

A cable can be coupled to a device which is responsive to tension applied to the cable for coupling the cable to the resistance disk, whereupon movement of the tensioned cable causes the resistance disk to move in a first direction, wherein the device is further responsive to no tension applied to the cable for either uncoupling the cable from the resistance disk or maintaining the cable uncoupled from the resistance disk. The device can be a toothed pawl that is pivotable against a spring force in response to the tension applied to the cable for meshing with a toothed gear of the resistance disk.

A rewind arm can be coupled between the spindle and the device. The rewind arm can be responsive to movement of the tensioned cable for movement of the rewind arm in the first direction against a spring bias between the rewind arm and the spindle. The rewind arm can further be responsive to the spring bias after release of the tension applied to the cable after said movement for moving the rewind arm in a second direction opposite the first direction.

In operation, the device and the resistance disk move in the first direction with the rewind arm in response to movement of the tensioned cable, and the device moves in the second direction with the rewind arm while the resistance disk remains stationary in response to release of the tension applied to the cable after said movement.

The spindle can be mounted to a stationary or movable object.

The exercise apparatus can further include a universal frame assembly coupled between the resistance disk and a stationary or moveable object. The universal frame assembly defines at least two independent rotational axes for the resistance disk with respect to an axis of the object.

The universal frame assembly can include: a T-arm including a first section and a second, transverse section, wherein the first section of the T-arm is rotatable about the axis of the object, and the second section of the T-arm is rotatable about an axis of the first section of the T-arm during rotation of the first section of the T-arm about the axis of the object; an elbow having a first end and a second end that faces in a direction transverse to the first end, wherein the first end of the elbow is coupled for rotation with the second section of the T-arm; and a sleeve having first and second ends, the first end of the sleeve coupled for rotation with the second end of the elbow, wherein the non-rotative spindle is coupled to the second end of the sleeve.

The invention is also a method of exercising comprising: (a) frictionally opposing rotation of a disk in response to movement of a cable tensioned in a first direction; (b) following step (a), causing the tension on the cable to be reversed to a second, opposite direction from the first direction; and (c) following step (b), while the disk remains stationary, causing the cable tensioned in the second direction to move in the second direction.

The method can further include: (d) frictionally opposing rotation of the disk in response to movement of the cable tensioned in the first direction; (e) following step (d), causing the tension on the cable to be reversed to a second, opposite direction from the first direction; and (f) following step (e), while the disk remains stationary, causing the cable tensioned in the second direction to move in the second direction.

The method can include repeating steps (d)-(f).

Lastly, the invention is an exercise apparatus comprising: a disk rotatable in a first direction against a frictional force; a device disposed between a cable and the disk, said device responsive to tensioning and movement of the cable in the first direction for coupling the cable to the disk whereupon the disk rotates against the frictional force with movement of the cable in the first direction, said device further responsive to release of the tension in the cable in the first direction for uncoupling the cable from the disk; and a rewind arm coupled between the disk and the device and responsive to the release of the tension in the cable in the first direction for tensioning and moving the cable in a second direction.

The disk can include a toothed gear and the device can comprise a toothed pawl that engages the toothed gear in response to tensioning of the cable in the first direction and which disengages the toothed gear in response to tensioning of the cable in the second direction.

The rewind arm can be biased against movement of the cable in the first direction and biased to move the cable in the second direction.

The disk can have a non-circular shape.

BRIEF DESCRIPTION OF THE DRAWINGS

FIG. 2 is an exploded perspective view of a resistance disk assembly.

FIG. 3 is a perspective view of an exercise resistance disk and a mounted handle grip accessory.

DETAILED DESCRIPTION OF THE INVENTION

Figure 1:
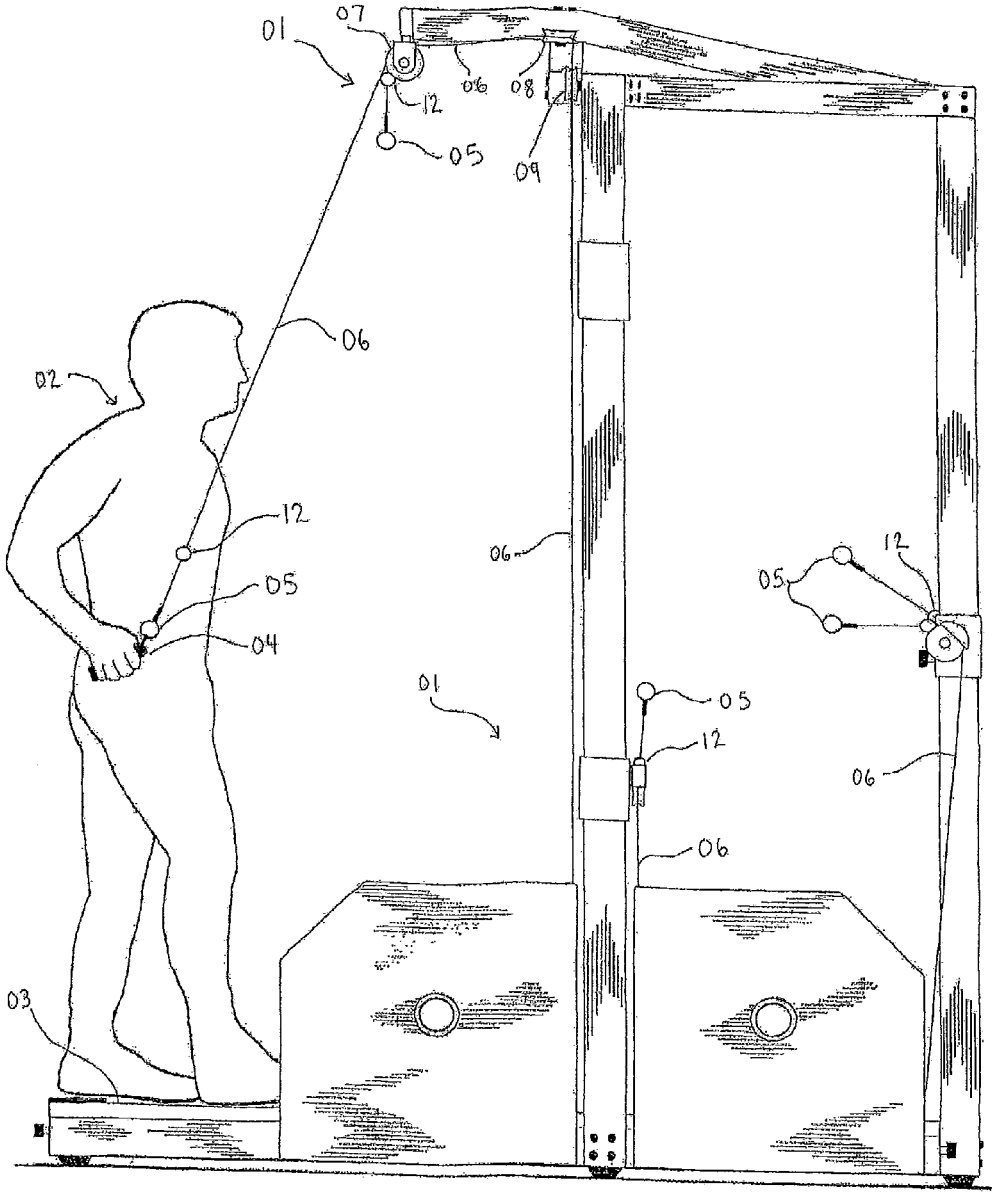
FIG. 1 is a side view of the exercise machine, and a person performing an exercise by pulling against an accessory cable.

FIG. 1 shows a side view of the invention 01 (hereafter referred to as exercise machine 01). A person 02 (hereafter referred to as user 02), can stand on the platform 03 and hold onto a detachable accessory like a hand grip 04 for example, to perform an exercise. The detachable accessory 04 can be attached to an eye loop connector 05, situated at the free end of a flexible steel cable, cord, strap, or the like (hereafter referred to as accessory cable 06). In the particular set-up shown, the accessory cable 06 is routed through a suspended pivot pulley 07, a non-pivotal pulley 08, and lastly a non-pivotal primary pulley 09, which is always aligned with the cable channel 10 situated on the periphery of the resistance disk 11 (see FIG. 5). A cable stop 12 is situated on each accessory cable 06, and sets the length of extended accessory cable 06 the user 02 desires to exercise with, by sliding it 12 along the accessory cable 06 to lengthen or shorten it 06. The user 02, is shown performing a lat exercise by pulling the hand grip accessory 04 and the attached accessory cable 06 in the advanced direction from above the user's 02 head, down to the user's 02 mid thigh.

FIG. 2 shows an exploded perspective view of the resistance disk assembly 13, used to motion simulate various bodily, sports like, or therapeutic actions, motions or exercises. It is understood, that an accessory cable 06 can either rest in, be unwound from, or can be slid back into the cable channel 10 situated around the periphery of the resistance disk 11 (see FIG. 5). It is understood, that a gear 14 is situated around the periphery of the resistance disk 11. An oil impregnated coaxial brass bushing 15, ball bearings or the like, is coaxially mounted in a complementary sized hole 16 at the center of the resistance disk 11 for the smooth rotation of the resistance disk assembly 13 about a non-rotative spindle 23. A flat, metal or the like, disk shaped pressure plate 17A is coaxially mounted to the top side of the resistance disk 11, and a flat, metal or the like, disk shaped pressure plate 17B is coaxially mounted to the bottom side of the resistance disk 11 using flat head screws 18 or the like. The resistance disk 11, the cable channel 10, and the gear 14 can all be of the same embodiment. For example, made from injection molded plastic, cast aluminum, cast iron, cast steel, composites, epoxy, fiberglass, polycarbonate, graphite or other materials like wood, particle board and can be made in different size diameters, depending on the model or application.

FIG. 3 shows a perspective view of an exercise resistance disk 19, used to perform circular motion or full range exercises. An oil impregnated coaxial brass bushing 15, ball bearings or the like, is coaxially mounted in a complementary sized hole 16 at the center of the exercise resistance disk 19 for it's 19 smooth rotation. A flat, metal or the like, disk shaped pressure plate 17A is coaxially mounted to the top side of exercise resistance disk, and a flat, metal or the like, disk shaped pressure plate 17B is understood to be coaxially mounted to the bottom side of the exercise resistance disk 19 using flat head screws 18 or the like. The exercise resistance disk 19 can be made from the same materials as the resistance disk 11 (described in FIG. 2). An accessory extension channel 71 (hereafter referred to as extension channel 71), is shown mounted to the top face of the exercise resistance disk 19. A detachable curved handle grip accessory 129, is one example of several different kinds of detachable accessories which can be used to rotate the exercise resistance disk 19 in a clockwise or counterclockwise direction about a non-rotative spindle 90. An extension channel 71 can also be mounted to the top face of the resistance disk assembly 13, making it a two-in-one or combination resistance disk. Which, enables the user 02 to motion simulate various bodily, sports like, or therapeutic actions, motions or exercises, or perform circular motion or full range exercises.

Figure 4:
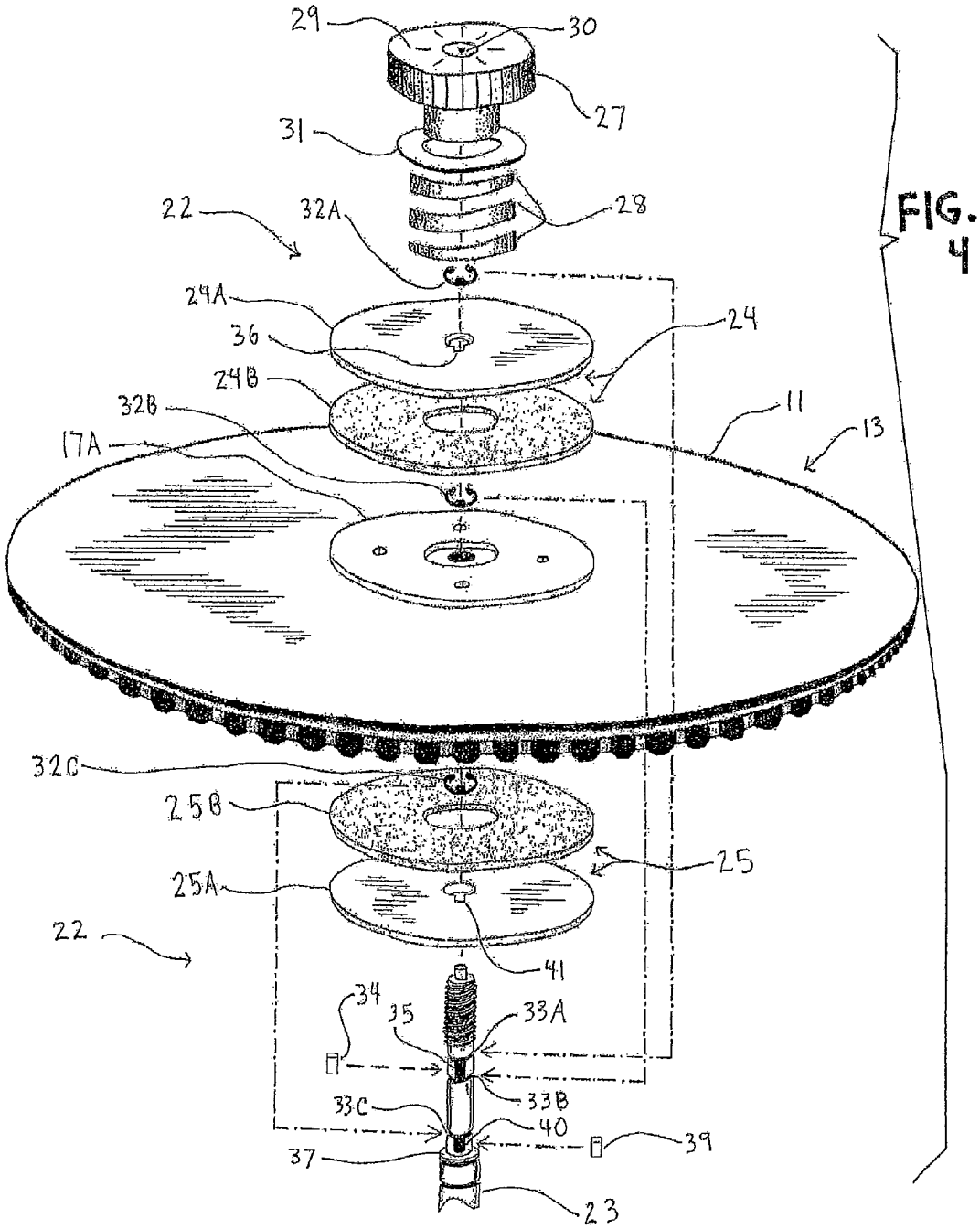
FIG. 4 is an exploded perspective view of the tension assembly and a perspective view of the resistance disk assembly.

FIG. 4 shows an exploded perspective view of the tension assembly 22, and a perspective view of the resistance disk assembly 13. It is understood, that frictional resistance is produced in the same manner for both, the resistance disk assembly 13 and the exercise resistance disk 19. However, is illustrated using only the resistance disk assembly 13. Frictional resistance is produced by the tension assembly 22, and pressure plates 17A and 17B mounted on either side of the resistance disk assembly 13, or the exercise resistance disk 19. The upper brake disk assembly 24, consists of a non-rotative upper brake disk 24A and paired brake disk pad 24B. The lower brake disk assembly 25, consists of a non-rotative lower brake disk 25A and paired brake disk pad 25B. The brake disk pads 24B and 25B can be adhered to the brake disks 24A and 25A using an adhesive or the like, or they can be made to be non-rotative, in the same manner as the non-rotative brake disks 24A and 25A for easy removal and replacement if the brake disk pads wear out. It is understood, that if the manufacturer makes the pressure plates 17A and 17B and brake disks 24A and 25A from certain compatible metals recommended for use in frictional conditions, the brake disk pads 24B and 25B may not be used. In operation, the user 02 forces the resistance disk assembly 13 or the exercise resistance disk 19 to rotate, as pressure plate 17A is in frictional contact with brake disk pad 24B of brake disk assembly 24 or brake disk 24A, and pressure plate 17B is in frictional contact with brake disk pad 25B of brake disk assembly 25 or brake disk 25A. The action of the brake disk assemblies 24 and 25, or brake disks 24A and 25A, pressing against pressure plates 17A and 17B mounted on either side of the rotating resistance disk assembly 13 or the rotating exercise resistance disk 19 creates frictional drag, thus a resistive force retarding the rotation of the resistance disk assembly 13, or the exercise resistance disk 19. This resistive force is constant, and can be adjusted by turning the tension knob 27 about a non-rotative threaded spindle 23 (refer to FIG. 10), or non-rotative threaded spindle 90 (refer to FIG. 13). Turning the tension knob 27 clockwise, increases the pressure between the tension knob 27 and the compression spring 28. Which, compresses the compression spring 28 against the top brake disk 24A. Thus, increasing the tension between brake disk assembly 24 and pressure plate 17A, and between brake disk assembly 25 and pressure plate 17B (refer to FIG. 10 or 13). A dial 29, situated on top of the tension knob 27, and a pointer 30 situated on top of the pointer 30 body coaxially aligned through a hole in the center of the tension knob 27 body and also coaxially mounted on the top end of the non-rotative spindle 23 or non-rotative spindle 90. Indicates the tension setting set against the rotation of the resistance disk assembly 13 or the exercise resistance disk 19 (refer to FIG. 10 or 13). A lubricated washer 31, coaxially mounted on the underside of the tension knob 27, helps ease in turning the tension knob 27, and keeps the compression spring 28 evenly centered on the brake disk 24A. The metal E-clip 32A which sits in groove 33A, and metal E-clip 32B which sits in groove 33B around the non-rotative spindle 23 or non-rotative spindle 90, holds one half of a hardened steel key 34 or the like, in a key way 35. While, the other half of the steel key 34 sits in a notch 36 situated on one side of the center hole in the upper brake disk 24A, preventing it 24A from rotating about the non-rotative spindle 23 or the non-rotative spindle 90. The lower brake disk 25A, is thicker than the upper brake disk 24A for added strength, and is coaxially mounted atop a shelf 37 on the non-rotative spindle body 23 or the non-rotative spindle body 90. The metal E-clip 32C which sits in groove 33C, is situated lower on the non-rotative spindle body 23 or the non-rotative spindle body 90, and holds one half of a hardened steel key 39 or the like, in a key way 40. While, the other half of the steel key 39 sits in a notch 41 situated on one side of the center hole in the lower brake disk 25A, preventing it 25A from rotating about the non-rotative spindle 23 or the non-rotative spindle 90. It is understood, that both the resistance disk assembly 13 and the exercise resistance disk 19, use the same tension assembly 22 configuration in the same manner to create frictional resistance.

Figure 5:
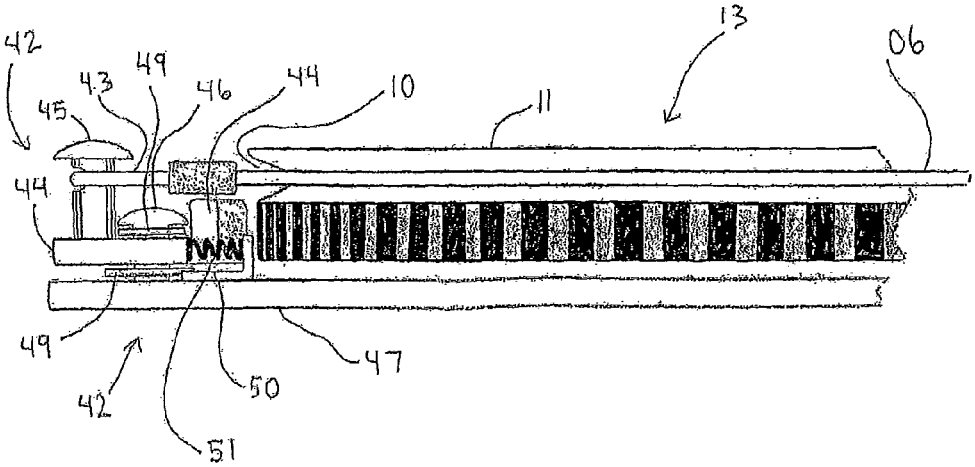
FIG. 5 is a side view of the outer portion of both, the resistance disk assembly and the rewind arm assembly.

FIG. 5 shows a side view of the outer section of both, the resistance disk assembly 13 and the rewind arm assembly 42. An eye loop cable connector 43 or the like, at the tail end of an accessory cable 06, is connected to a pawl 44 body by means of a securely fastened shoulder screw cable connector 45, or the like. The accessory cable 06 is shown at rest in a cable channel 10, that is understood to extend around the periphery of the resistance disk 11. A shoulder screw 46 or the like, is understood to be aligned through a curved slot 48 in the pawl 44 body (see FIG. 6), and securely fastened to the rewind arm 47. Washers 49, coaxially situated on shoulder screws 46, and 53 are used as spacers to support and hold the pawl 44 body loosely in position. An L-bracket 50 or the like, can be fastened to the rewind arm 47 using small screws, rivets or the like, or the L-bracket 50 can be molded as part of the same rewind arm 47 embodiment. A small compression spring 51, rests against the pawl 44 body and is understood to be secured to the L-bracket 50 using a screw fastener or the like. The compression spring 51 is fully extended and the pawl 44 is at rest, when the accessory cable 06 is at rest and not pulled against by the user 02.

Figure 6:
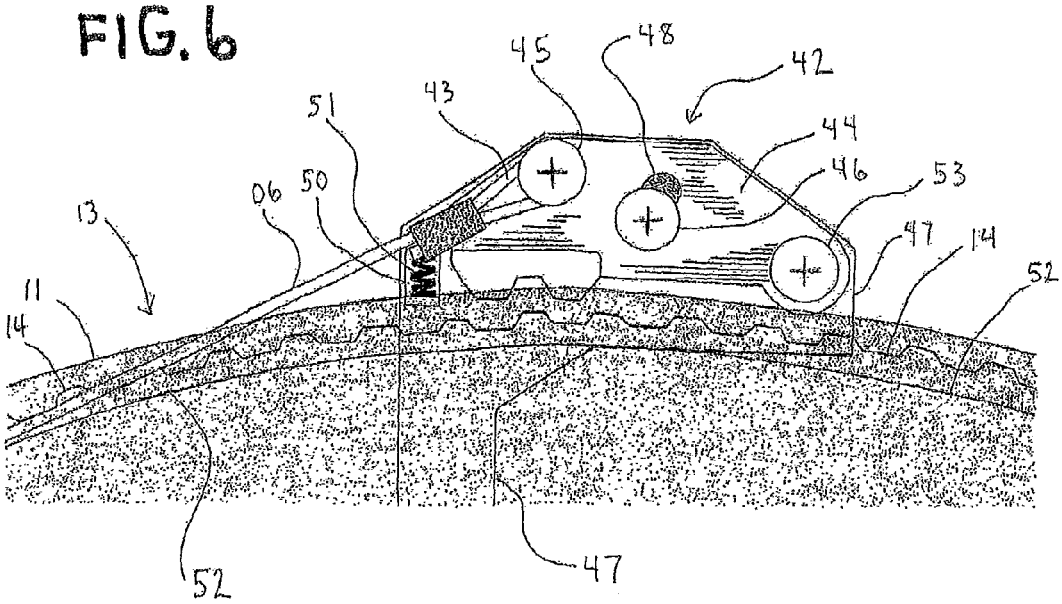
FIG. 6 is a top view of the outer portion of the transparent resistance disk assembly and the rewind arm assembly shown in FIG. 5, and the attached accessory cable.

FIG. 6 shows a top view of the outer section of both, the resistance disk assembly 13 and the rewind arm assembly 42 shown in FIG. 5. Shows the resistance disk 11, is made of a transparent see through material to better show the hard to see gear 14, and the hard to see inside wall 52 of the cable channel 10 where the accessory cable 06 rests against. Shows the eye loop cable connector 43, at the tail end of the accessory cable 06 is connected to the toothed pawl 44 by means of the shoulder screw cable connector 45. The pawl 44, is mounted to pivot about a shoulder screw 53 or the like, which is securely fastened to the rewind arm 47. The securely fastened shoulder screw 46 limits the outward pivoting motion of the pawl 44, and is aligned in a curved slot 48 in the pawl 44 body. The arc of the curved slot 48 is relative to the axis point of shoulder screw 53. The pawl 44, is understood to be resting against the shoulder of shoulder screw 46 by the expanding force of the small compression spring 51.

Figure 7:
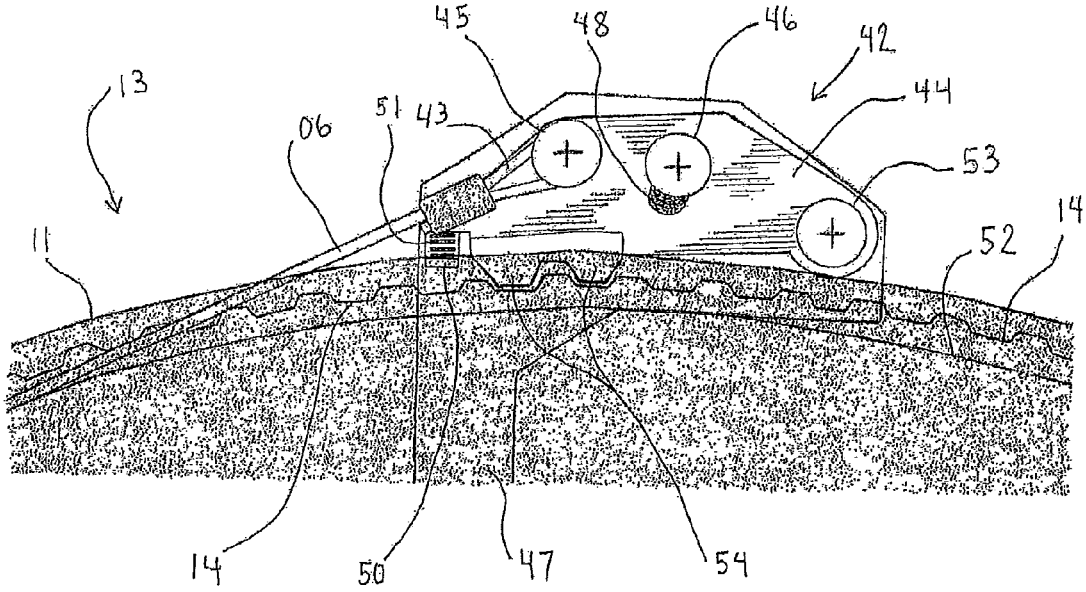
FIG. 7 is a top view of the pawl mechanism of the rewind arm assembly engaged to a gear situated on the periphery of the transparent resistance disk assembly.

FIG. 7 shows a top view of the outer section of both, the resistance disk assembly 13 and the rewind assembly 42 shown in FIG. 6. Shows the resistance disk 11, is made of a transparent see through material to better show how the hard to see toothed pawl 44 has engaged the gear 14 situated on the periphery of the resistance disk assembly 13. In operation, the user 02 starts pulling against the accessory cable 06 in the advanced direction. By this action, slack in the accessory cable 06 tightens up as the eye loop cable connector 43 pulls against the shoulder screw cable connector 45. Which, urges the pawl 44 to pivot about shoulder screw 53 in an inwardly direction towards the gear 14 on the periphery of the resistance disk assembly 13. Simultaneously, the curved slot 48 in the pawl 44 body pulls away from resting against shoulder screw 46, and the pawl 44 body depresses the small compression spring 51 against the L-bracket 50 as the teeth 54 of the pawl 44 body come to fully engage a complementary toothed gear 14 on the periphery of the resistance disk assembly 13. Thereby, joining the rewind arm 47 of the rewind arm assembly 42 to the periphery of the resistance disk assembly 13. At this point, the resistance disk assembly 13 and joined rewind arm 47 start to rotate in unison about a mounted non-rotative spindle 23 as the user 02 pulls against the accessory cable 06 in the advanced direction and against an applied frictional resistive force (refer to description of the invention in FIG. 4). It is understood, that a frictional resistive force is being applied against the pull of the accessory cable 06 in the advanced direction only, and not in the retracting direction as the user 02 returns to the original position to repeat another repetition during an exercise routine.

Figure 8:
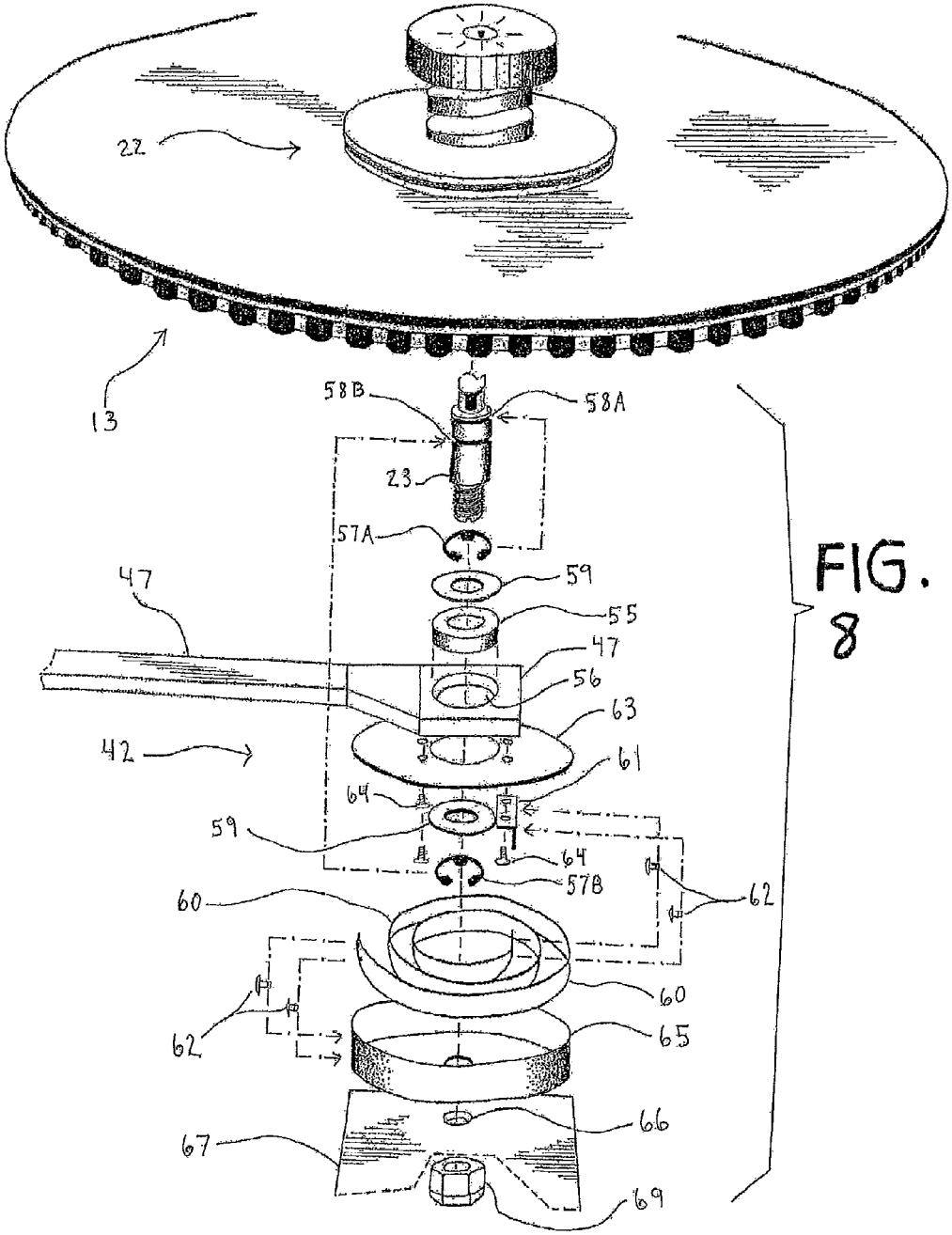
FIG. 8 is a perspective view of the resistance disk assembly and the tension assembly, and an exploded perspective view of the inner portion of the rewind arm assembly.

FIG. 8 shows a perspective view of the resistance disk assembly 13 and the tension assembly 22, and an exploded perspective view of the inner section of the rewind arm assembly 42. It is understood, that an oil impregnated coaxial brass bushing 55, ball bearing or the like, is coaxially mounted in a complementary shaped hole 56 towards the innermost part of the rewind arm 47, and is coaxially mounted on a spindle 23. The rewind arm assembly 42 is held in location on the spindle 23 by means of a metal E-clip 57A mounted in a groove 58A above the rewind arm 47, and a metal E-clip 57B mounted in a groove 58B below the rewind arm 47, along with washers 59 used as spacers between the E-clips 57A and 57B and the rewind arm 47 (refer to FIG. 10). A coil spring 60 is disposed concentrically around the spindle 23. The inner end of the coil spring 60 is mounted to an L-bracket 61 or the like, using pop-rivets 62 or the like. The L-bracket 61 is mounted to the underside of both, the disk shaped coil spring housing cover 63 and the rewind arm 47 using flat head screws 64 or the like. The rewind arm 47, the coil spring housing cover 63, and the L-bracket 61 could all be of the same embodiment, made from cast aluminum, injection molded plastic or the like. The outer end of the coil spring 60 is mounted to the coil spring housing 65 using pop-rivets 62 or the like. The bottom end of the spindle 23 is threaded, and can be secured to a mounting hole 66 in a mounting bracket 67 mounted inside a resistance disk encasement 68 (refer to FIG. 9), inside a platform 03, or to any frame, frame section or mounting bracket with a mounting hole, by using a lock nut 69 or the like.

Figure 9:
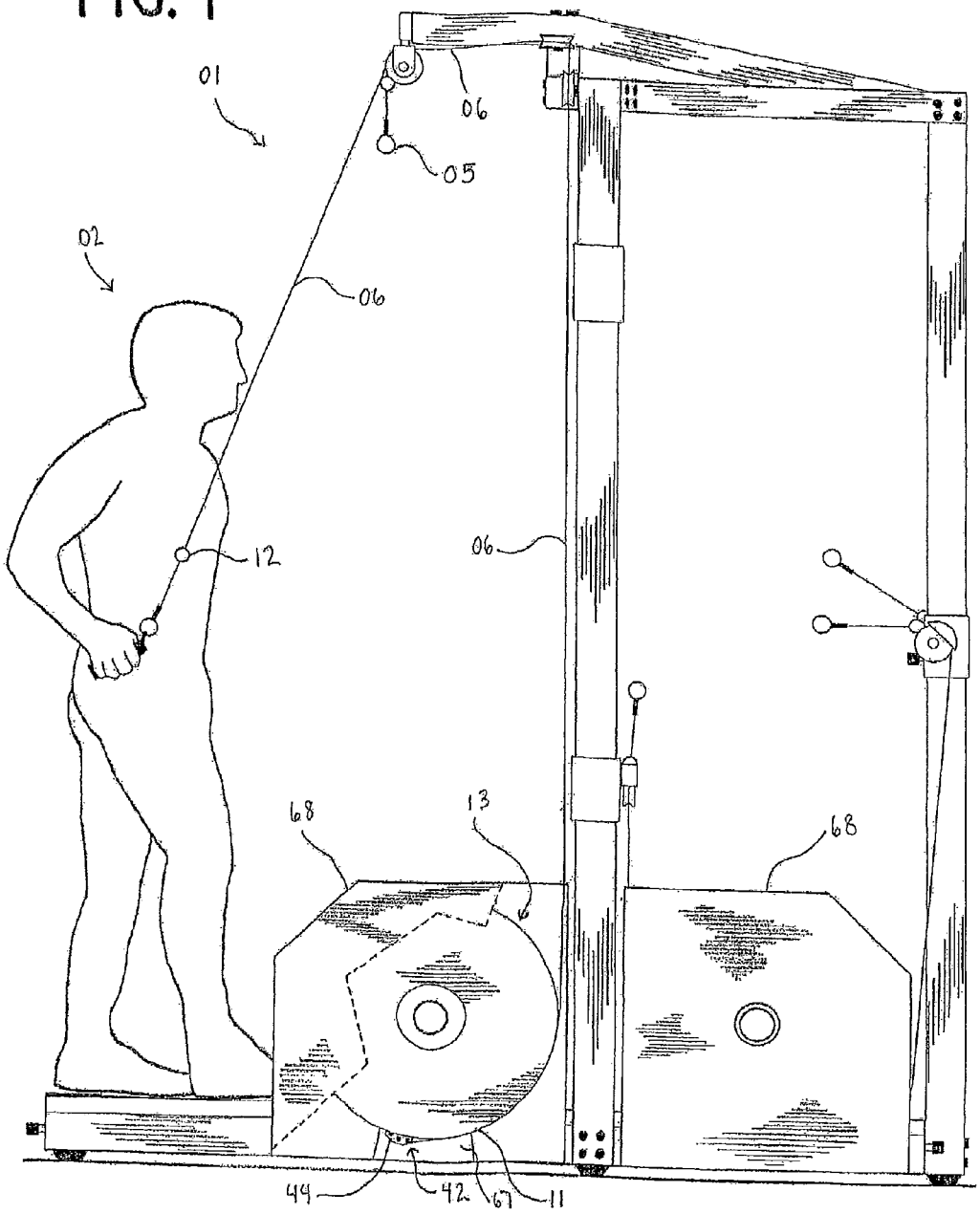
FIG. 9 is a side view of the exercise machine, to show the rewind arm assembly has engaged the periphery of the resistance disk assembly by the pull of the accessory cable, as depicted in FIG. 7.

FIG. 9 shows a side view of the exercise machine 01 and the user 02 exercising. The side panel of a resistance disk encasement 68 has been partially removed to show the exercise machine 01 in operation. As the resistance disk assembly 13 and joined rewind arm 47 start to rotate in unison about a mounted non-rotative spindle 23 by the user 02 pulling against the accessory cable 06 in the advanced direction, as mentioned earlier (in FIG. 7). Simultaneously, the accessory cable 06 is starting to be unwound from the cable channel 10 situated on the periphery of the rotating resistance disk assembly 13, and a cable stop 12 situated towards the free end of the accessory cable 06 is being lifted away from resting against the particular pulley it's 06 routed through. It is understood, that the coil spring 60, already preloaded with a small amount of tension, is being wound tighter and increases with more and more tension the further the resistance disk assembly 13 and joined rewind arm 47 are being rotated in the advance direction by the pull of the accessory cable 06. The amount of increased tension in the coil spring 60 being applied against the pull of the accessory cable 06 is nominal. The user 02, can pull and unwind the accessory cable 06 from the cable channel 10 to any length between one and sixty-five inches if using a disk measuring about twenty-one inches in diameter. The diameter of the resistance disk assembly 13 and the cable channel 10 determines the length of cable 06 that can be extended. However, a longer length of accessory cable 06 can be used if the cable channel 10 is made wide enough to hold more adjoining windings of accessory cable 06. When the accessory cable 06 reaches the limit to which it can be pulled, or upon the user 02 stopping the pull against the accessory cable 06, the resistance disk assembly 13 immediately stops rotating. By this action, the pawl 44 disengages the gear 14 on the periphery of the resistance disk assembly 13 by the small amount of slack that's now in the accessory cable 06, and by the deformed compression spring 51 expanding outward. Thus, urging the pawl 44 body to pivot away from the gear 14 on the periphery of the resistance disk assembly 13. Simultaneously, the tension that has built up in the coil spring 60 from the rotation of the resistance disk assembly 13 and joined rewind arm 47 pulled in the advanced direction, forces the rewind arm 47 and attached accessory cable 06 to rewind back in the opposite direction. Thereby, retracting or pulling the accessory cable 06 back into the cable channel 10 situated on the periphery of the stopped or non-rotating resistance disk assembly 13, in preparation for another pull of the accessory cable 06.

Figure 10:
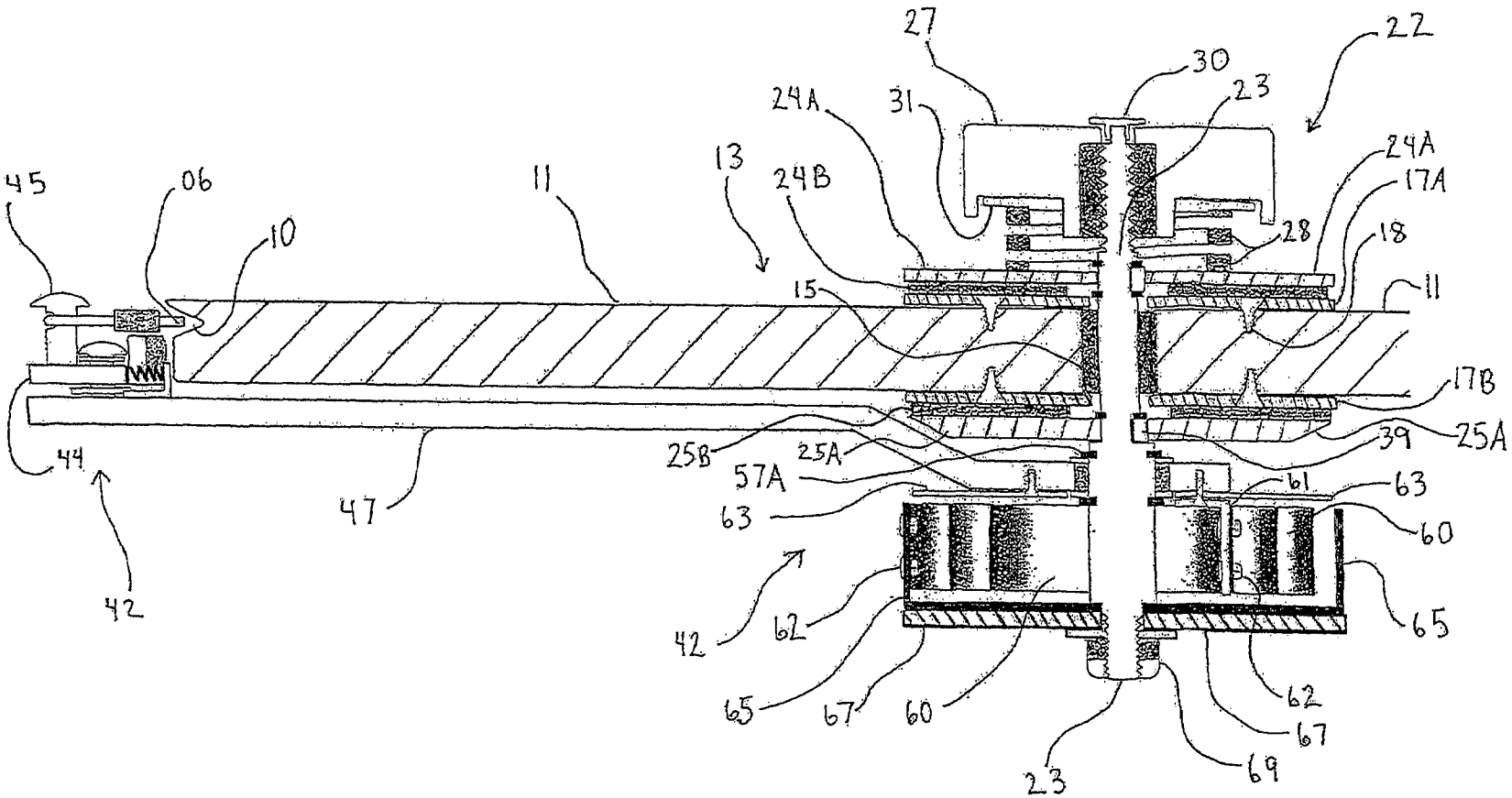
FIG. 10 is a cross section view of the tension assembly, the resistance disk assembly, and the inner portion of the rewind arm assembly fully assembled.

FIG. 10 shows a cross section view of the resistance disk assembly 13 (in FIG. 2), the tension assembly 22 (in FIG. 4), and the inner section of the rewind arm assembly 42 (in FIG. 8) in their assembled configuration. Shows the outer section of the rewind arm assembly 42 and the cut end of the accessory cable 06 (in FIG. 5). Also shows the upper brake disk assembly 24, and the lower brake disk assembly 25 (in FIG. 4). It is understood, that the threaded spindle 23 of the resistance disk assembly 13 embodiment is mountable to any stationary or portable body harness, object or surface with a mounting hole using a lock nut 69, or is mountable to a mounting bracket with a mounting hole that's mounted to another stationary or movable object or surface using a lock nut 69.

Figure 11:
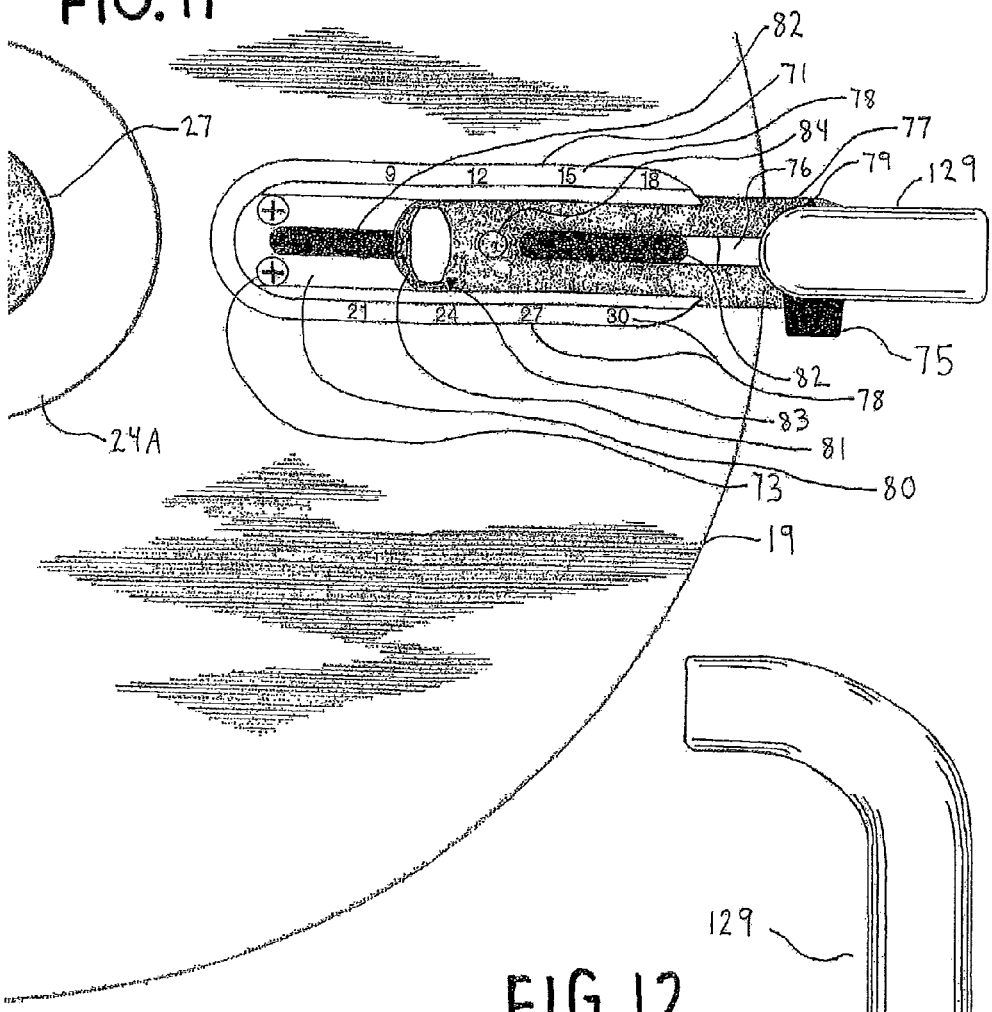
FIG. 11 is a top view of an extension channel and an extension arm that's attached by a curved handle grip accessory, which is used to rotate the exercise resistance disk.

FIG. 11 shows a top view, of the extension channel 71, the extension arm 77, a detachable curved handle grip accessory 129, and a section of the exercise resistance disk 19. In operation, the user 02 can use a curved handle grip accessory 129 for example, to exercise their arm in a circular motion by applying enough physical force against the curved handle grip accessory 129 to rotate the exercise resistance disk 19 against an applied frictional resistive force (refer to description of the invention in FIG. 4). The exercise resistance disk 19 can be rotated in a clockwise or counterclockwise direction. One or more extension channels 71 can be fastened to the top face of the exercise resistance disk 19 using flat head screws 73 or the like. The extension channel(s) 71 and the exercise resistance disk 19 can all be of the same embodiment, made of cast aluminum, molded plastic or the like. The detachable curved handle grip accessory 129 can be screwed onto or off of the threaded non-rotative accessory mount 74 by turning the lever arm 75 or the like, situated on the base 70 of the curved handle grip accessory 129 (refer to FIG. 12). The curved handle grip accessory 129, or any detachable accessory, can be changed to another position within the elongated slot 76 in the extension arm 77 body by turning the lever arm 75, then sliding the loosened accessory mount 74 and accessory 129 to a desired setting. Which, is indicated by a diameter gauge 78 situated on the face of the extension channel 71, and a pointer 79 situated on the accessory mount 74. Then, can turn the lever arm 75 to lock the curved handle grip accessory 129 in place. For the user 02, to exercise in a circular motion wider than the diameter of the exercise resistance disk 19 itself. The user 02, can unlock the extension arm 77 that rests in a complementary shaped channel 80 situated in the extension channel 71 body by loosening a studded wing knob 81 that's aligned through a hole in the extension arm 77 body, and screwed to a T-nut that's understood to be able to slide along the underside of the elongated slot 82 in the extension channel 71 body. The user 02, can then slide and extend the loosened extension arm 77 outward to a desired setting indicated by a diameter gauge 78 situated on the face of the extension channel 71 that corresponds to a pointer 83 situated on the face of the extension arm 77. It is understood that a ball plunger, index pin or the like, extends outward and engages an index hole understood to be in the extension channel 71 body, helping assist in the fast and easy positioning of the extension arm 77. A stabilizer pin 84, understood to be part of the extension arm 77 embodiment, is understood to be aligned in the elongated slot 82 in the extension channel 71 body, which helps support the extension arm 77 when it's 77 fully extended.

Figure 12:
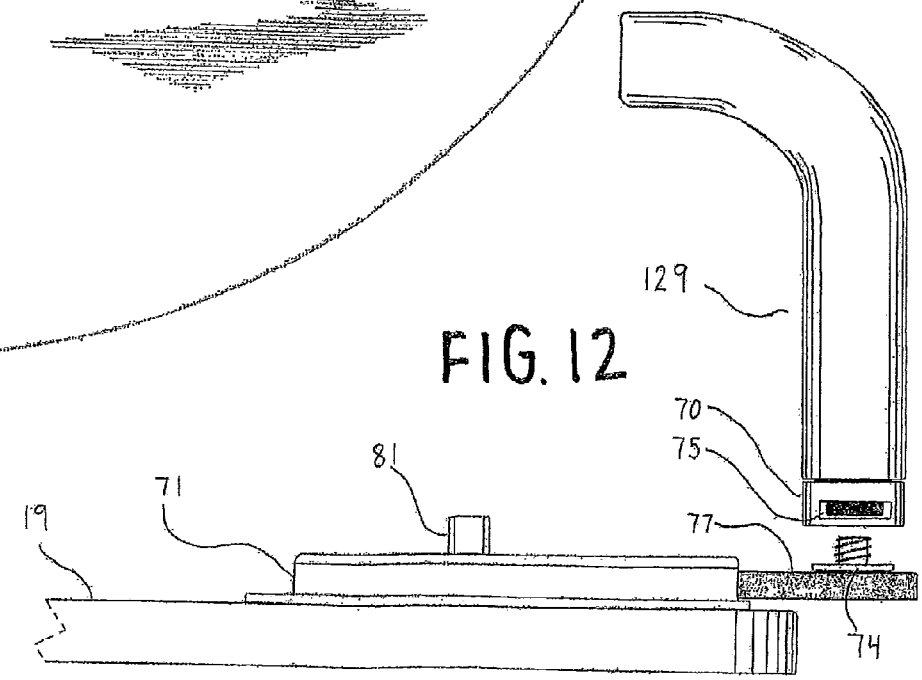
FIG. 12 is a side view of the extension channel and paired extension arm, mounted to the exercise resistance disk shown in FIG. 11, and a side view of the detached curved handle grip accessory.
Figure 13:
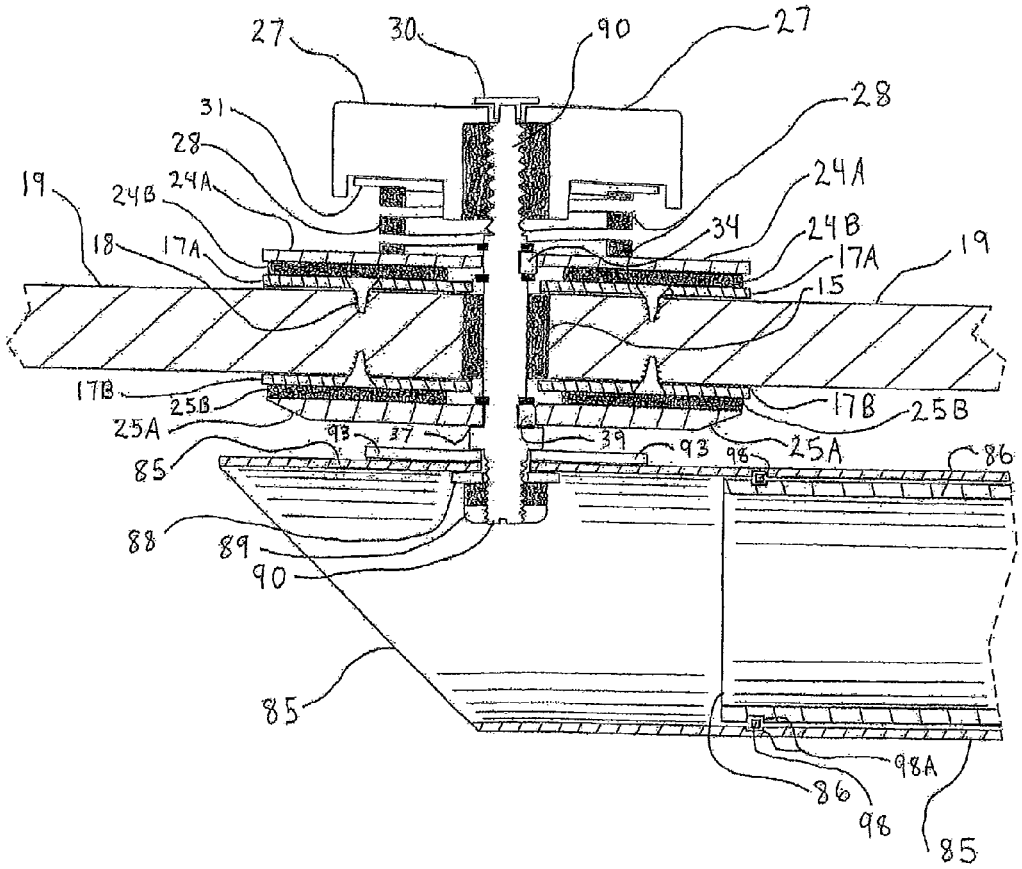
FIG. 13 is a cross section view of the tension assembly, the center section of the exercise resistance disk, and the outermost ends of the T-arm sleeve and elbow frame sections.

FIG. 12 shows a side view, of the extension channel 71, the outer section of the extension arm 77, a section of the exercise resistance disk 19, and an unattached curved handle grip accessory 129. It is understood, that a threaded hole coaxially situated in the base 70 of detachable accessories 129 or 145 can be screwed onto the non-rotative accessory mount 74 by turning the lever arm 75 until the base 70 is on tight. It is understood that the slide adjustable accessory mount 74 can also be mounted to the elongated slot 82 in the extension channel 71 for mounting a detachable accessory to the extension channel 71. FIG. 13 shows a cross section view, of the exercise resistance disk 19 (in FIG. 3), and the tension assembly 22 (in FIG. 4) in their assembled configuration. Also shows a cross section view of the outer section of the T-arm sleeve 85 frame section, and the elbow 86 frame section of the universal frame assembly 92 (in FIG. 14) loosely held together by means of a retaining ring 98 arranged in radial grooves 98A. It is understood, a retaining ring 98 arranged in radial grooves 98A, loosely holds the elbow frame section 86 and the T-arm frame section 87 together. Spherical washer 88 and lock nut 89 fastens the threaded spindle 90 to mounting bracket 93 and the T-arm sleeve 85, or 90 is mountable to any stationary or portable object or harness with a mounting hole, or is mountable to a mounting bracket with a mounting hole mounted to another stationary or movable object or surface.

Figure 14:
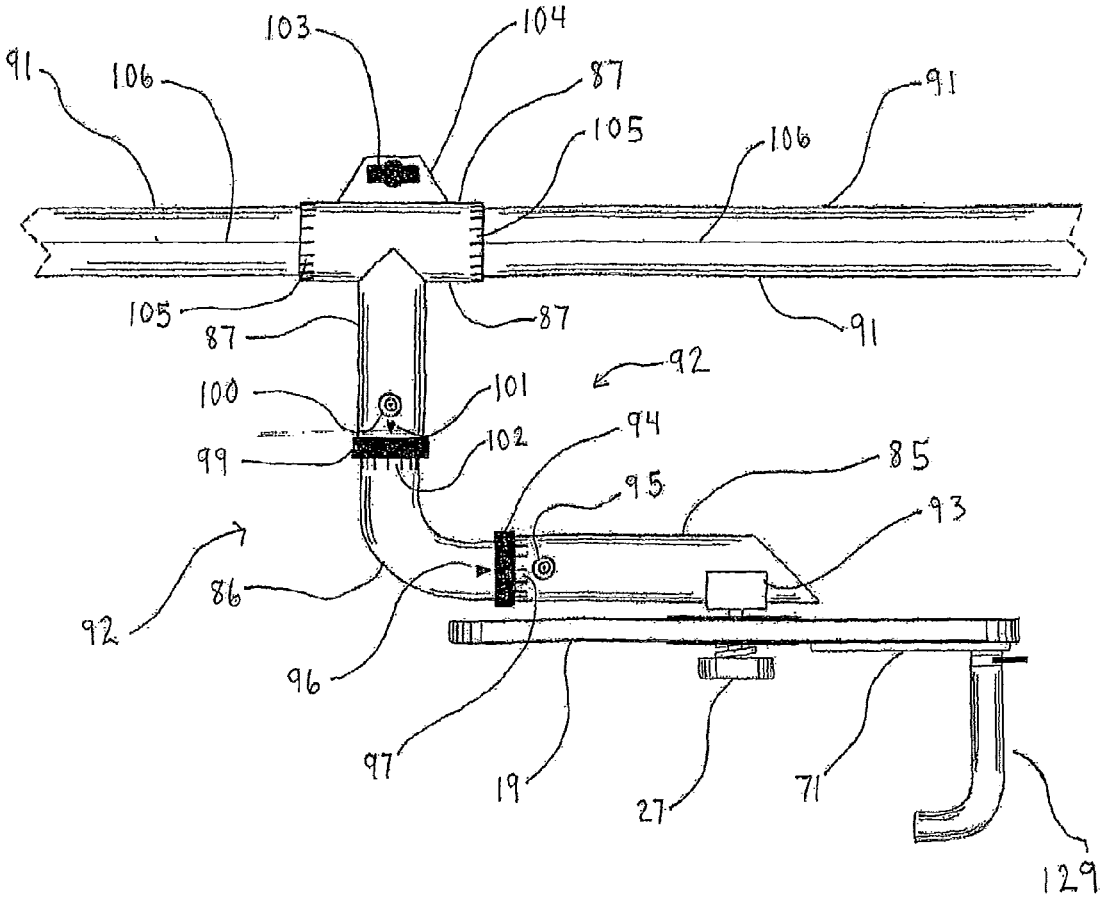
FIG. 14 is a top view of the elevation bar, and the T-arm, elbow, and T-arm sleeve frame sections of the universal frame assembly, also shows the exercise resistance disk mounted to the T-arm sleeve.

FIG. 14 shows the top view, of the center section of the elevation bar 91, and an universal frame assembly 92. An exercise machine may consist of one, or many universal frame assemblies 92 and paired exercise resistance disks 19. The three independently adjustable frame sections 85, 86 and 87 of the universal frame assembly 92, enables the exercise resistance disk 19 to be adjusted to any angle in relation to the user 02. The elevation bar 91 adjusts the height of the universal frame assembly 92. The exercise resistance disk 19, is fastened to a mounting bracket 93 and the T-arm sleeve 85 using a spherical washer 88 and a lock nut 89 (refer to FIG. 13). The round tubular inner end of the T-arm sleeve 85, is coaxially situated to rotate about the smaller round tubular outer end of an L-shaped frame section 86 (referred to as elbow 86). To change the angle of the exercise resistance disk 19 using the T-arm sleeve 85, the user 02 can slightly unscrew and loosen a threaded collar 94 that's coaxially situated on the threaded innermost end of the T-arm sleeve 85. Then, can disengage a ball plunger 95, index pin or the like, to unlock the set position of the T-arm sleeve 85. Which, is now free to be rotated on an axis three hundred sixty degrees in either a clockwise or counterclockwise direction about the elbow 86 to a desired position. Indicated by a pointer 96 located on the elbow 86, which corresponds to the dial 97 setting located on the T-arm sleeve 85. Simultaneously, the ball plunger 95 extends outward and into the corresponding index hole understood to be radially arranged around the elbow 86 body, holding the T-arm sleeve 85 in position. Then, can screw tighten the collar 94 to firmly lock the T-arm sleeve 85 in place. The round tubular inner end of the elbow 86, is coaxially situated inside the larger round tubular outer end of the T-shaped frame section 87 (referred to as T-arm 87). To change the position of the exercise resistance disk 19 using the elbow 86, the user 02 can slightly unscrew and loosen a threaded collar 99, that's coaxially situated on the threaded outermost end of the T-arm 87. Then, can disengage a ball plunger 100, index pin or the like, to unlock the set position of the elbow 86. Which, is now free to be rotated on an axis three hundred sixty degrees, in a clockwise or counterclockwise direction about the T-arm 87 to a desired position. Indicated by a pointer 101 located on the T-arm 87, which corresponds to the dial 102 setting located on the elbow 86. Simultaneously, the ball plunger 100 extends outward and into the corresponding index hole or the like, understood to be radially arranged around the elbow 86 body, holding the elbow 86 in position. Then, can screw tighten the collar 99 to firmly lock the elbow 86 in place. To change the angle of the exercise resistance disk 19 using the T-arm 87, the user 02 can slightly unscrew and loosen a studded wing knob 103. Which, increases the lengthwise separation that is understood to be between the bottom and top flanges 104, situated at the top end of the T-arm 87. Thus, lessening the clamping pressure of the T-arm 87 around the round tubular elevation bar 91, making it 87 loose. Then, the user 02 can rotate the loosened T-arm 87 three hundred sixty degrees in a clockwise or counterclockwise direction about the axis of the elevation bar 91, or can slide it 87 along sideways, to a desired position. Indicated when the desired setting on the dial 105 is aligned with a line marker 106 situated lengthwise along the elevation bar 91. Then the T-arm 87 can be locked in place by tightening the wing knob 103. The elevation bar 91 can be a horizontal or vertical support, depending on the frame's configuration.

Figure 15:
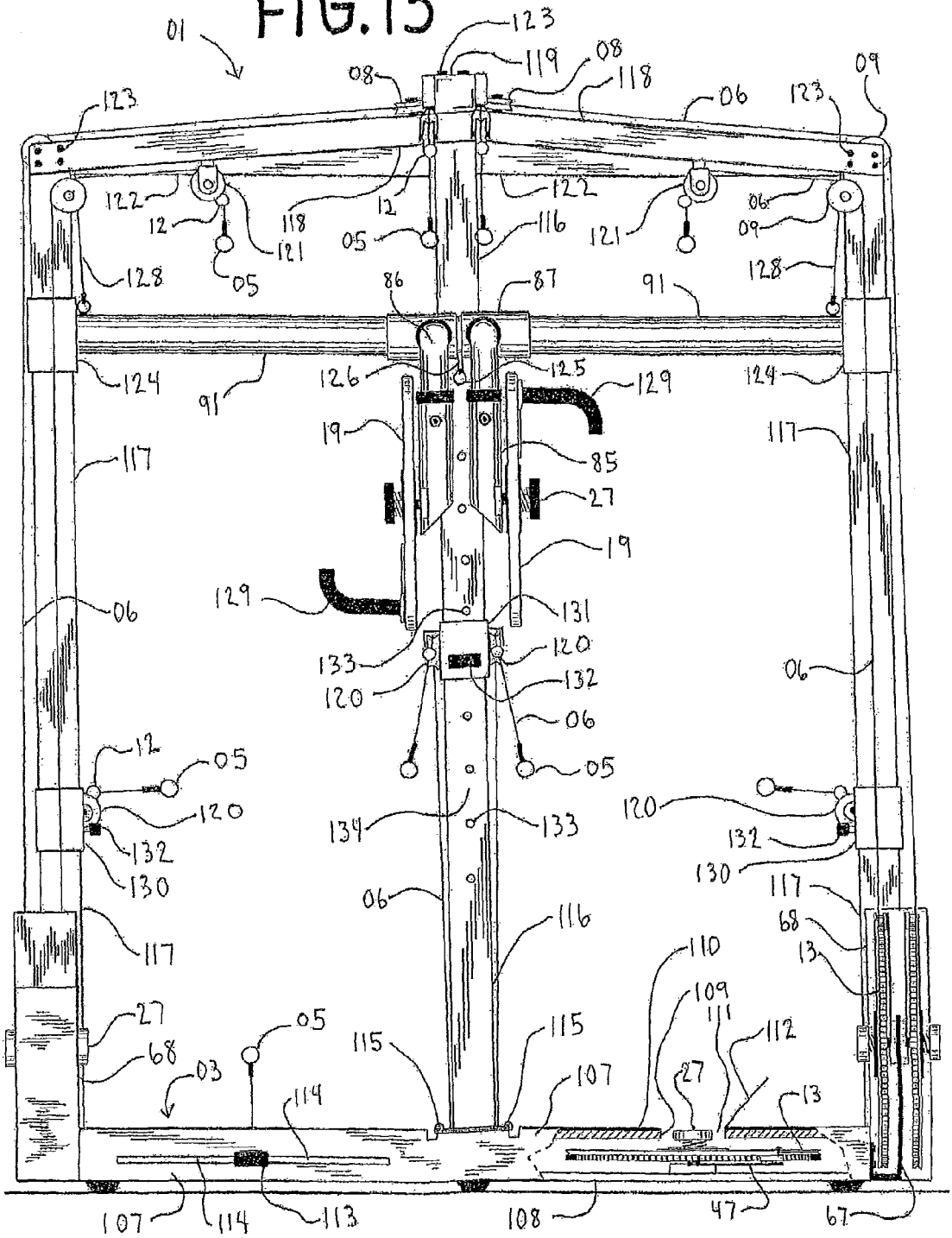
FIG. 15 is a front view of the exercise machine.

FIG. 15 shows the front view of the exercise machine 01. It is understood, that the resistance disk encasements 68 can be mounted to either side of the platform 03 using fasteners. Shows the front cover of a resistance disk encasement 68 has been removed, to show that one or more resistance disk assemblies 13 can be mounted to a mounting bracket 67 or the like, situated inside a resistance disk encasement 68. Shows part of the platform's 03 front cover 107 has been cut away, to show that a resistance disk assembly 13 can be mounted to the inside of a platform 03, like to a crossbar 108 or the like. Also shows that the platform's 03 metal frame can be covered by plywood 109 or the like, and a skid proof rubber mat 110, which have been cut away to show a hole 111 situated in the top of the platform 03. Enabling the user 02 to access the resistance disk assembly's 13 tension knob 27 by opening a small hinged access door 112. A studded wing knob 113, used to loosen and slide a mounted pulley 09, located inside the platform 03, along an elongated slot 114 in the front cover 107 of the platform 03. A rail 115 or the like, understood to be situated down the center of the platform 03, enables the user 02 to use accessories like a rower seat or workout bench with wheels to roll back and forth on while exercising. It is understood, that a square tubular support column 117 is securely fastened to either side of the platform 03 using fasteners 123. A slightly bent square tubular crossbar 118, is securely fastened to both side columns 117 and the upper cross piece 119 using fasteners 123. It 118, also supports two stationary pulleys 08, and two suspended pivot pulleys 121 being slide adjustable within two elongated slots understood to be running lengthwise on the underside of the crossbar 118. It is understood, two crossbars 122 are fastened between the rear column 116 and each side column 117 situated on either side of the exercise machine 01 using fasteners 123. It is understood, that the rear column 116, the two side columns 117, crossbars 122 and 118, and the upper cross piece 119, can be made of square or round tubular metal, or the like. The height adjustable elevation bar 91, has a square tubular column sleeve 124 perpendicularly situated at each end. A hanging ring pull 125 is attached to the ends of two steel cables 126 or the like. Which, are routed through a small hole, understood to be situated at the center on the underside of the elevation bar 91. To change the height of the resistance disk assemblies 13 using the elevation bar 91, the user 02 can pull against the ring pull 125. By this action, the two steel cables 126 separately routed in opposite directions through the inside of the hollow elevation bar 91 and linked to spring loaded index pins or the like, understood to be situated on the innermost side of each column sleeve 124. Are disengaged from resting inside the index holes 133 of both height gauges 134, understood to be situated on the innermost side of both side columns 117. Thus, freeing the elevation bar 91, which enables the user 02 to raise or lower the elevation bar 91 to a desired height. Then, can release the ring pull 125, which urges both spring loaded index pins to extend outward and into the index holes 133 of both height gauges 134, thereby locking the elevation bar 91 in position. The index holes 133 and height gauge 134, are also situated on the rear column 116. It is understood, that a counterweight 140 is suspended inside each side column 117 using a cable 128. Each cable 128 is routed through a pulley 141 situated at the top of each side column 117(refer to FIG. 17), and then connected to each end of the elevation bar 91. The counterweights 140, will counter the weight of the elevation bar 91, the universal frame assemblies 92 and the exercise resistance disks 19 for the easy positioning of the elevation bar 91. Similar to how counterweights work in the opening and closing of a double hung window. A curved handle grip accessory 129, is shown attached to each exercise resistance disk 19. A stationary pulley 120, is mounted to a square tubular column sleeve 130 situated on each side column 117. A stationary pulley 120, is mounted on either side of the square tubular column sleeve 131, situated on the rear column 116. The height of the stationary pulleys 120 can be adjusted by pulling out a release pin 132, index pin or the like. Then, can raise or lower column sleeve 130 or 131 to the desired height, and reinsert the release pin 132 into the corresponding index hole 133 of the height gauge 134 situated on columns 116 or 117.

Figure 16:
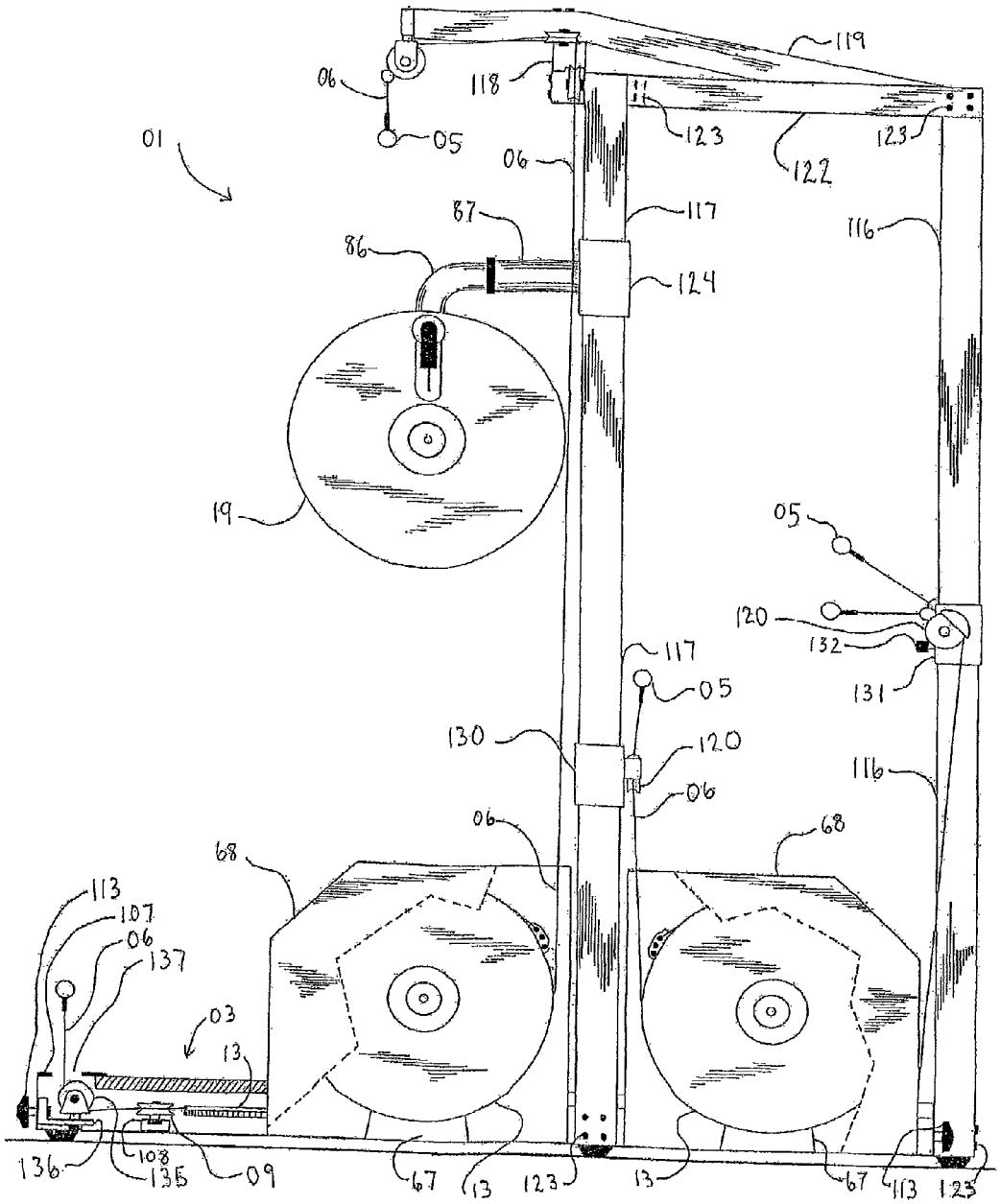
FIG. 16 is a side view of the exercise machine.
Figure 17:
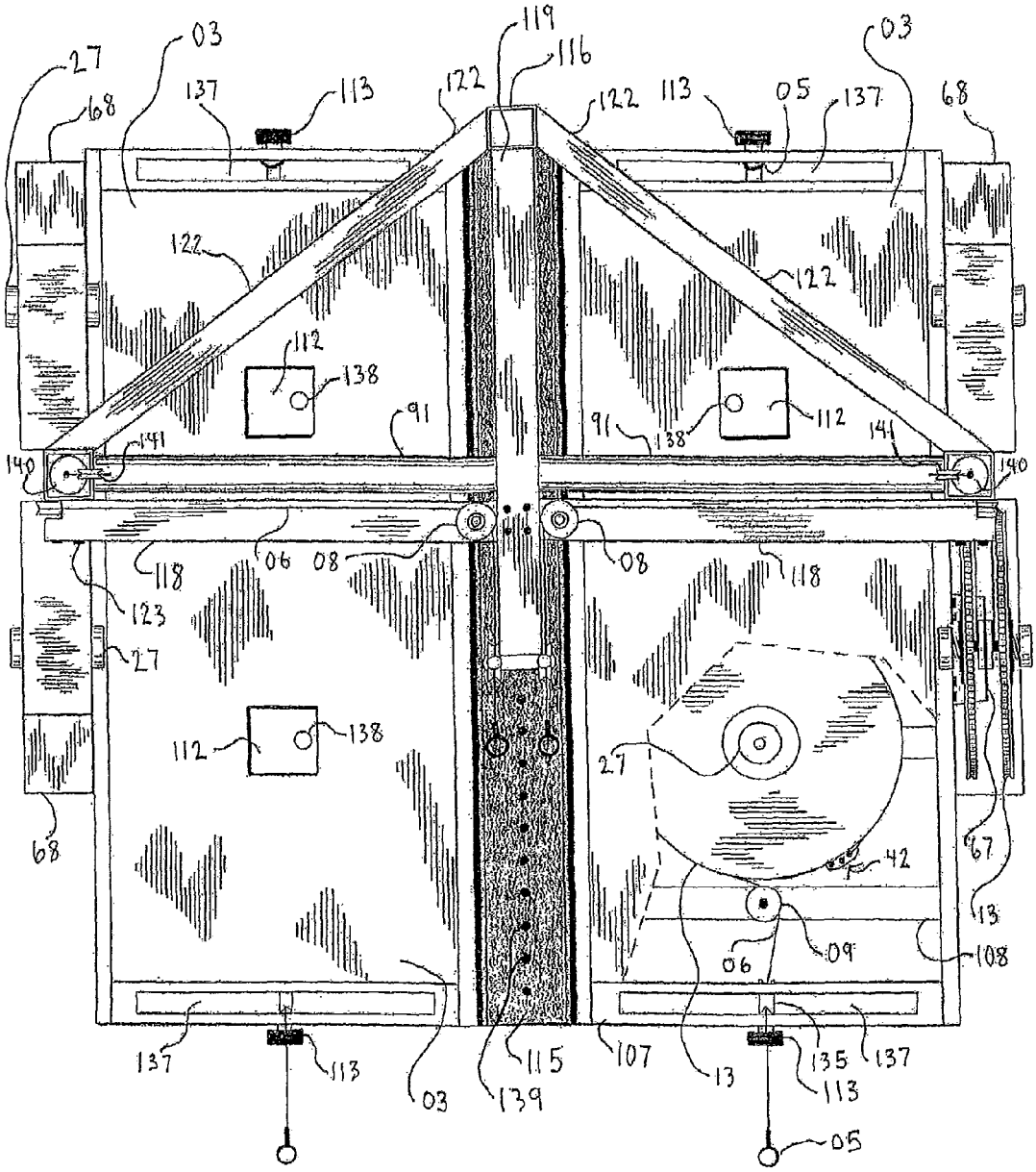
FIG. 17 is a top view of the exercise machine.

FIG. 16 shows a side view of the exercise machine 01. It is understood, that two resistance disk encasements 68 are mounted to both sides of this particular type exercise machine 01. It is understood, that one or more resistance disk encasements 68 can be mounted to any frame type structure, or to any surface like a wall, floor, or ceiling, depending on the configuration of exercise machine and or the application. Shows the side cover of a rear resistance disk encasement 68 is cut away, to show the accessory cable 06, understood to be situated on the periphery of a resistance disk assembly 13, is at rest and is routed to a stationary pulley 120 that's mounted to a column sleeve 130. The cover of the front resistance disk encasement 68 is also cut away, to show the accessory cable 06 and the resistance disk assembly 13 at rest. The resistance disk assemblies 13 in both encasements 68 are understood to be mounted to mounting holes in the mounting brackets 67 using lock nuts 69. The mounting brackets 67, are understood to be mounted to the frame of the platform 03 using fasteners 123. It also shows the side cover and frame of the platform 03 have been removed, to show that an accessory cable 06 is routed from the periphery of a resistance disk assembly 13 to a stationary primary pulley 09 mounted on a crossbar 108. Then, continues to a pivot pulley 135, that's mounted to a pulley assembly bracket 136, and out through an elongated opening 137 understood to be in the top of the front cover 107 of the platform 03 (refer to FIG. 17). To change the position of that particular accessory cable 06, the user 02 can slightly unscrew and loosen a studded wing knob 113 situated on the front cover 107 of the platform 03. Which, loosens the pulley assembly bracket 136 situated inside the platform 03. Enabling the user 02 to slide the loosened wing knob 113 along the outside of the elongated slot 114 in the front cover 107 (refer to FIG. 15), while the attached pulley assembly bracket 136 is being slid along the inside of the elongated slot 114 inside the platform 03. Thus, changing the position of the accessory cable 06. Then, the user 02 can lock the pulley assembly bracket 136 in place and the pulley 135 in position by tightening the wing knob 113. Shows a crossbar 122 is fastened between a side column 117 and the rear column 116 for added structural support using fasteners 123. FIG. 17 shows a top view of the exercise machine 01. Shows the upper cross piece 119 is fastened to both, the rear column 116 and the crossbar 118 using fasteners 123. Shows part of the platform 03 is cut away, to better show the accessory cable 06 is routed from the periphery of the resistance disk assembly 13 to a primary pulley 09, then to a pivot pulley 135, and lastly out through an elongated opening 137 situated in the top of the front cover 107, described in (description of the invention for FIG. 16). The elongated slot 114, understood to be situated on the front of the front cover 107 of the platform 03 (see FIG. 15), is relative to the elongated opening 137 situated on the top of the front cover 107 of the platform 03. Shows a ring 138, hole or the like, used to open an access door 112 in the platform 03 in order to adjust the tension knob 27. Shows index holes 139 aligned down the center of the rail 115, which are used to lock an accessory like a rower seat or workout bench with wheels in position. It is understood, that there can be one or more resistance disk assemblies 13 mounted inside a platform 03. Shows this exercise machine 01 has four resistance disk assemblies 13 understood to be mounted to cross bars 108 or the like, situated inside the platform 03. A small portable model my have one or two lightweight resistance disk assemblies 13 mounted per platform. An even smaller portable model may consist of just one resistance disk assembly 13, mountable to any stationary or movable object, surface or mounting bracket with a mounting hole like a body harness, a wall, floor or ceiling, or the like. Shows the four wing knobs 113 outside the platform 03, are relative to the four resistance disk assemblies 13 mounted inside the platform 03. Also shows the counterweights 140 suspended inside the two side columns 117, the two pulleys 141 and the cables 128 used to counter the weight of the elevation bar 91, the universal frame assemblies 92, and the exercise resistance disks 19 (refer to FIG. 15).

Figure 18:
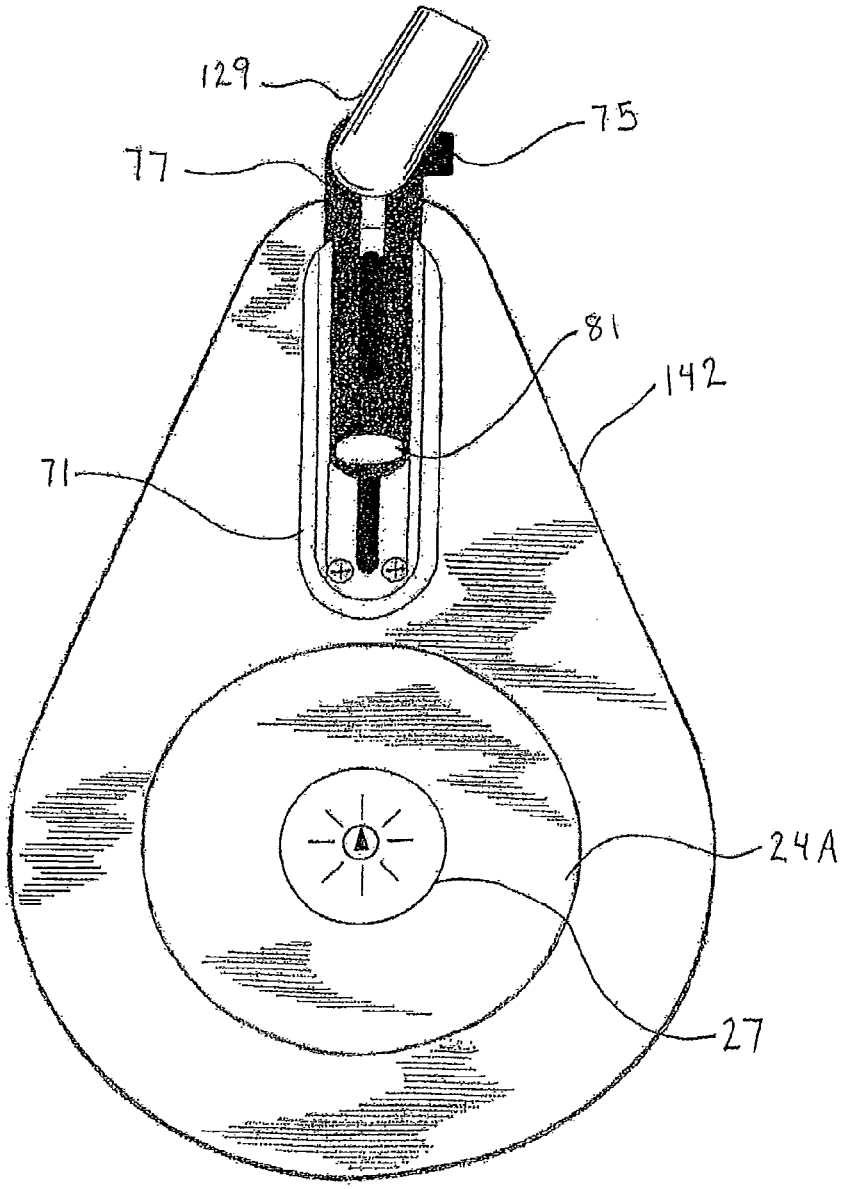
FIG. 18 is a top view of a modified version of the exercise resistance disk.
Figure 19:
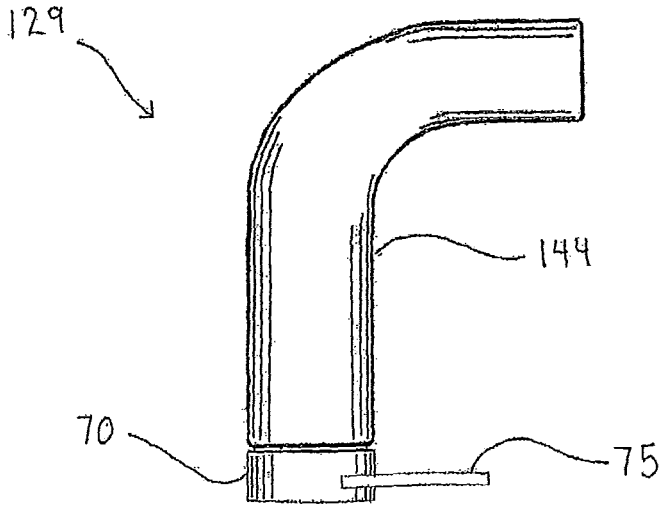
FIG. 19 is a side view of a detachable curved handle grip accessory.

FIG. 18 shows the top view of a modified version of the exercise resistance disk 19, reduced in mass to a pear shaped disk 142 (hereafter referred to as modified resistance disk 142). However, it works in the same manner as the circular shaped exercise resistance disk 19, being comprised of the same components including, the pressure plates 17A and 17B, the tension assembly 22, the extension channel 71, and the extension arm 77. The modified resistance disk 142 can be reduced even further to a skeleton like frame. Where, just the extension channel 71 and bottom pressure plate 17B are combined together to be of the same embodiment, and comprised of little or no modified resistance disk 142 body. The rest of the tension assembly 22 (refer to FIG. 4), and the extension arm 77 are basically in the same configuration. FIG. 19 shows the side view of a detachable curved handle grip accessory 129, used to rotate the exercise resistance disk 19 repeatedly. The curved handle grip accessory 129 consists of a base 70 with a threaded hole understood to be coaxially situated at it's 70 center. A lever arm 75, used to tighten the base 70 of the curved handle grip accessory 129 to an accessory mount 74. A curved handle 144 with a foam rubber grip. The straight part of the curved handle 144 is coaxially mounted to rotate about an inner shaft understood to be part of the base 70. The shape of the curved handle grip accessory 129, enables the user 02 to grip the curved handle grip accessory 129 from different angles. Therefore, the user 02 can exercise their arm in a circular motion at broader angles in relation to the exercise resistance disk 19.

Figure 20:
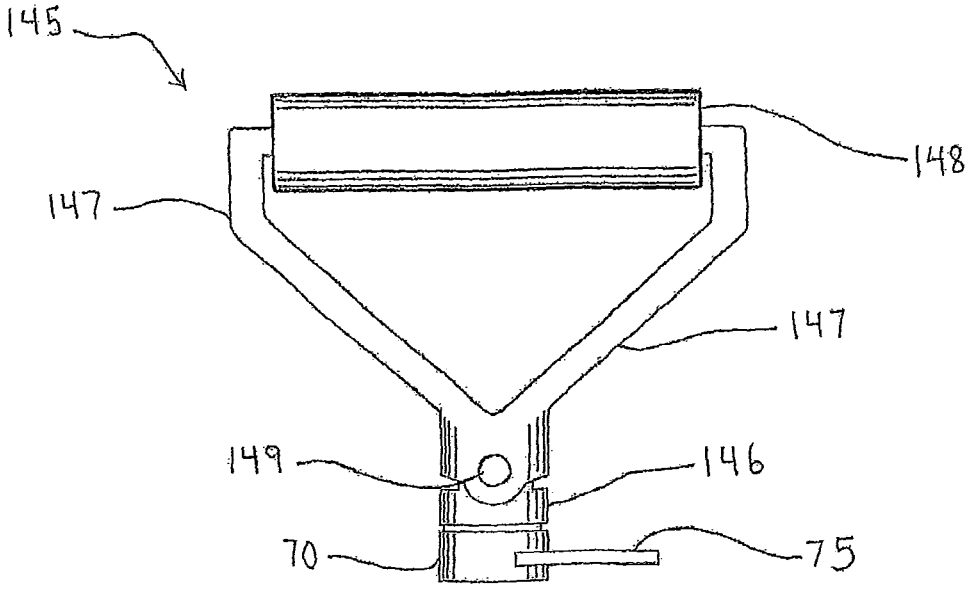
FIG. 20 is a side view of a detachable swinging hand grip accessory.

FIG. 20 shows the side view of a detachable swinging hand grip accessory 145, used to rotate the exercise resistance disk 19 repeatedly. The swinging hand grip accessory 145 consists of a base 70 with a threaded hole understood to be coaxially situated at it's 70 center. A lever arm 75, used to tighten the base 70 of the swinging hand grip accessory 145 to an accessory mount 74. A center section 146, that is coaxially mounted to rotate about the base 70 by means of a heavy duty pin, rivet or the like. Which, is understood to be aligned through center holes in both, the top of the base 70 and the bottom of the center section 146, holding them securely together, but loose enough for the center section 146 to rotate freely about the base 70. The innermost end of the hand grip frame 147 is loosely joined to the top of the center section 146 by means of a pin 149 or the like, forming a movable joint. Which, enables the hand grip frame 147 to swing or rock back and forth on the axis of pin 149. The hand grip 148 is mounted on the outermost end of the hand grip frame 147. The relative position of the swinging hand grip accessory 145, enables the user 02 to grip the swinging hand grip accessory 145 from broad angles. Therefore, the user 02 can exercise their arm in a circular motion at many different angles in relation to the exercise resistance disk 19.

Figure 21:
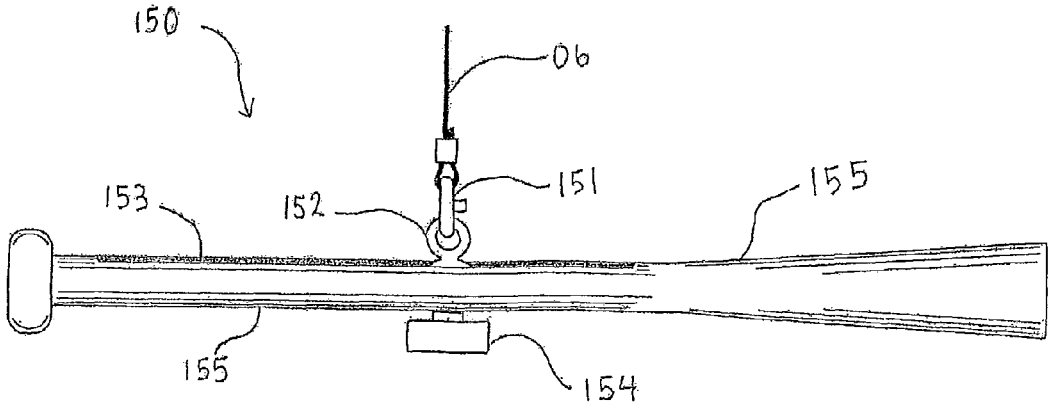
FIG. 21 is a top view of a bat simulator accessory and an attached accessory cable.

FIG. 21 shows the top view of a bat simulator accessory 150. Which, strengthens the particular muscles used to swing a baseball or softball bat. It is understood, that a resistive force is applied against the user's 02 swing (refer to description of the invention in FIG. 7). The bat simulator body 155 weighs as much as an average baseball bat by means of implanted weights, and is about half the length of an average baseball bat. It can be made from wood, plastic, aluminum or the like. A clasp 15, fastener or the like, attached to the free end of the accessory cable 06, can be attached to an eye bolt cable connector 152 or the like. The threaded end of the eye bolt cable connector 152 is aligned through an elongated slot 153 in the bat simulator body 155 and screwed to a threaded wing knob 154 or the like. To change the leverage applied to the user's 02 wrists, the user 02 can slightly unscrew and loosen the wing knob 154. Then, can slide the loosened eye bolt cable connector 152 along the elongated slot 153, either inward for more leverage or outward for less leverage. Then, can screw tighten the wing knob 154, which also tightens the eye bolt cable connector 152 in place.

Figure 22:
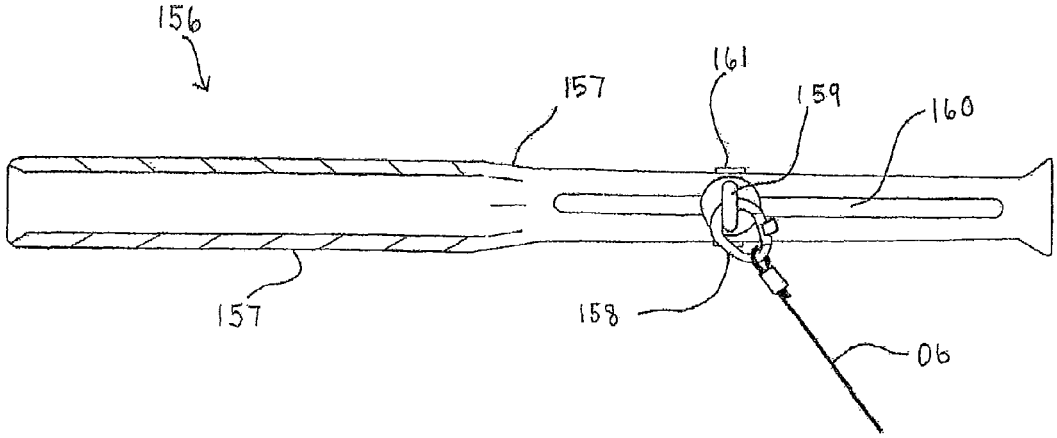
FIG. 22 is a side view of a racket simulator accessory and an attached accessory cable.

FIG. 22 shows the side view of a racket simulator accessory 156. Which, strengthens the particular muscles used to swing a tennis racket, racket ball racket or a squash racket. It is understood, that a resistive force is applied against the user's 02 swing (refer to description of the invention in FIG. 7). The racket simulator body 157 weighs as much as an average racket by means of implanted weights, and is about half the length of an average tennis racket. It can be made from wood, plastic, aluminum or the like. A clasp 158, fastener or the like, attached to the free end of the accessory cable 06, can be attached to an eye bolt cable connector 159 or the like. The threaded end of the eye bolt cable connector 159 is aligned through an elongated slot 160 in the racket simulator body 157 and is understood to be screwed to a threaded wing knob 161 or the like. To change the leverage applied to the user's 02 wrists, the user 02 can slightly unscrew and loosen the wing knob 161. Then, can slide the loosened eye bolt cable connector 159 along the elongated slot 160, either inward for more leverage or outward for less leverage. Then, can screw tighten the wing knob 161, which also tightens the eye bolt cable connector 159 in place.

Figure 23:
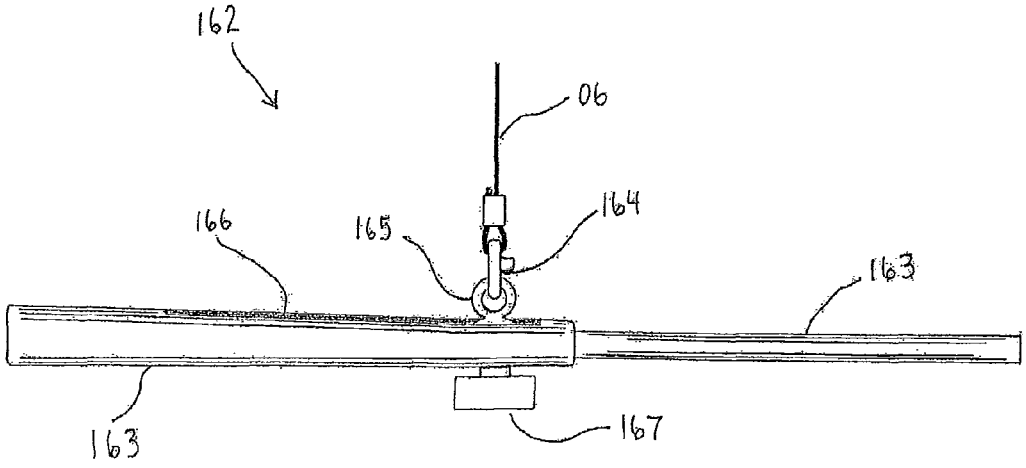
FIG. 23 is a side view of a golf club simulator accessory and an attached accessory cable.

FIG. 23 shows the side view of a golf club simulator accessory 162. Which, strengthens the particular muscles used to swing a golf club. It is understood, that a resistive force is applied against the user's 02 swing (refer to description of the invention in FIG. 7). The golf club simulator body 163 weighs about as much as an average golf club by means of implanted weights, and is about half the length of an average golf club. It can be made from wood, plastic, aluminum or the like. A clasp 164, fastener or the like, attached to the free end of an accessory cable 06, can be attached to an eye bolt cable connector 165 or the like. The threaded end of the eye bolt cable connector 165 is aligned through an elongated slot 166 in the golf club simulator body 163 and is understood to be screwed to a threaded wing knob 167 or the like. To change the leverage applied to the user's 02 wrists, the user 02 can slightly unscrew and loosen the wing knob 167. Then, can slide the loosened eye bolt cable connector 165 along the elongated slot 166, either inward for more leverage or outward for less leverage. Then, can screw tighten the wing knob 167, which also tightens the eye bolt cable connector 165 in place.

Figure 24:
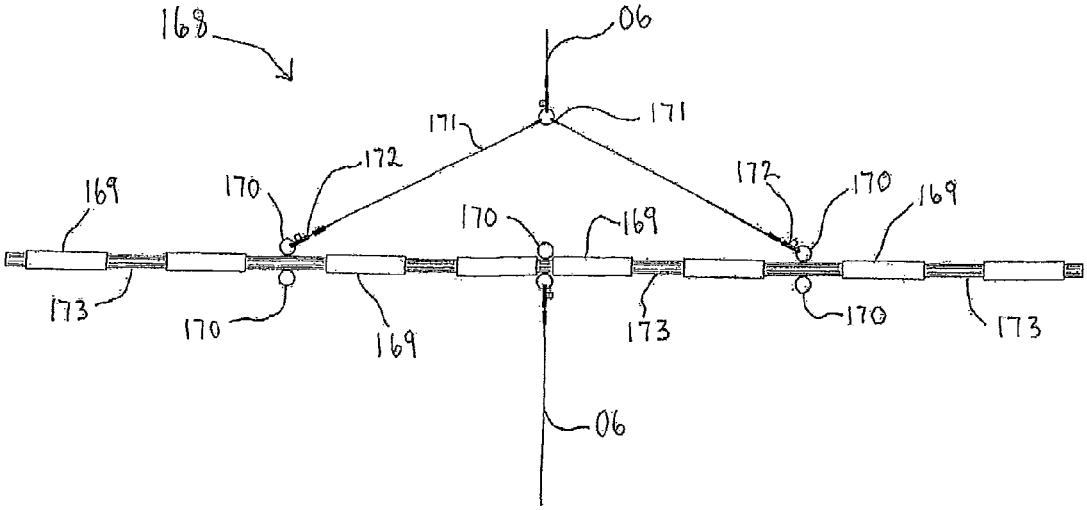
FIG. 24 is a side view of a two-way bar accessory, attached by a cable adapter and accessory cable on the top side, and an accessory cable on the bottom side.

FIG. 24 shows the side view of a two-way extension bar accessory 168 (hereafter referred to as two-way bar 168). The two-way bar body 173 can be straight or bent and made of round tubular lightweight aluminum tubing or the like, and can be a long or short in length. Regularly spaced foam rubber hand grips 169, enables the user 02 to grip the two-way bar 168 at different points along it's 168 length to perform various exercises. Eye bolt cable connectors 170 or the like, are situated on both, the top and bottom sides of the two-way bar 168, at the center, and half way towards either end. Enabling the user 02 to attach accessory cables 06 to either the top, the bottom, or both the top and bottom sides of the two-way bar 168 at the same time. Which, enables the user 02 to push against the two-way bar 168 in one direction, urging a resistance disk assembly 13 to rotate. Then, the user 02 can pull against the two-way bar 168 in the opposite direction, urging a second resistance disk assembly 13 to rotate. Therefore, the user 02 can perform two-way or push-then-pull exercises by using two separate resistance disk assemblies 13, alternately. An accessory cable adapter 171 with clasp connectors 172 or the like, can be used to connect an accessory cable 06 to two eye bolt cable connectors 170 at one time, to evenly distribute the load forced on the two-way bar 168 while performing heavy duty exercises. There are other common exercise accessories the user 02 can attach to the accessory cable adapter 171 like hand grips 04, loops, wrist straps, ankle straps, etc.

The invention has been described with reference to preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An exercise apparatus comprising:

a resistance disk including an aperture for receiving a non-rotative spindle therethrough for rotation of the resistance disk on the non-rotative spindle;

a pair of brake disk pads removably mounted on to the spindle for non-rotation therewith on opposite sides of the resistance disk, the resistance disk rotatable on the spindle when the spindle is received in the resistance disk aperture such that the pair of brake disk pads frictionally opposes rotation of the resistance disk on the spindle; and the pair of brake disk pads mounted between a pair of brake disks which are removably mounted on the spindle and fixedly coupled to the brake disk pads and to the spindle when the spindle is received in the resistance disk aperture.

2. The exercise apparatus of claim 1, further including a pair of pressure plates fixedly mounted on opposite sides of the resistance disk between the pair of brake disk pads.

3. The exercise apparatus of claim 1, further including a bushing fixedly mounted in the resistance disk aperture for rotation of the bushing and the resistance disk about the non-rotative spindle disposed in an aperture of the bushing.

4. The exercise apparatus of claim 1, further including a tension assembly coupled between the spindle and the resistance disk and operative for increasing or decreasing a frictional force applied by the brake disk pads to the resistance disk.

5. The exercise apparatus of claim 4, wherein the tension assembly includes a spring mounted between the spindle and the resistance disk, and a knob for adjusting the frictional force that the spring causes the brake disk pads to apply to the resistance disk.

6. The exercise apparatus of claim 1, further including a handle coupled to the resistance disk.

7. The exercise apparatus of claim 6, further including means for adjusting a position of the handle relative to the resistance disk.

8. The exercise apparatus of claim 1, wherein the spindle is mounted to a stationary or movable object.

9. The exercise apparatus of claim 1, further including a universal frame assembly coupled between the resistance disk and a stationary or moveable object, said universal frame assembly defining at least two independent axes about which the resistance disk is rotatable with respect to an axis of the object.

10. An exercise apparatus comprising:

a resistance disk including an aperture for receiving a non-rotative spindle therethrough for rotation of the resistance disk on the non-rotative spindle;

a pair of brake disk pads mounted on opposite sides of the resistance disk and coupled to the spindle for non-rotation therewith when the spindle is received in the resistance disk aperture such that the pair of brake disk pads frictionally oppose rotation of the resistance disk on the spindle; and a cable coupled to a device which is responsive to tension applied to the cable for coupling the cable to the resistance disk, whereupon movement of the tensioned cable causes the resistance disk to move in a first direction, wherein the device is further responsive to no tension applied to the cable for either uncoupling the cable from the resistance disk or maintaining the cable uncoupled from the resistance disk.

11. The exercise apparatus of claim 10, wherein the device is a toothed pawl that is pivotable against a spring force in response to the tension applied to the cable for meshing with a toothed gear of the resistance disk.

12. The exercise apparatus of claim 10, further including a rewind arm coupled between the spindle and the device, the rewind arm responsive to movement of the tensioned cable for movement of the rewind arm in the first direction against a spring bias between the rewind arm and the spindle, the rewind arm further responsive to the spring bias after release of the tension applied to the cable after said movement for moving the rewind arm in a second direction opposite the first direction.

13. The exercise apparatus of claim 12, wherein:

the device and the resistance disk move in the first direction with the rewind arm in response to movement of the tensioned cable; and the device moves in the second direction with the rewind arm while the resistance disk remains stationary in response to release of the tension applied to the cable after said movement.

14. An exercise apparatus comprising:

a disk rotatable in a first direction against a frictional force;

a device disposed between a cable and the disk, said device responsive to tensioning and movement of the cable in the first direction for coupling the cable to the disk whereupon the disk rotates against the frictional force with movement of the cable in the first direction, said device further responsive to release of the tension in the cable in the first direction for uncoupling the cable from the disk; and a rewind arm coupled between the disk and the device and responsive to the release of the tension in the cable in the first direction for tensioning and moving the cable in a second direction.

15. The exercise apparatus of claim 14, wherein:

the disk includes a toothed gear; and the device comprises a toothed pawl that engages the toothed gear in response to tensioning of the cable in the first direction and which disengages the toothed gear in response to tensioning of the cable in the second direction.

16. The exercise apparatus of claim 14, wherein the rewind arm is biased against movement of the cable in the first direction and biased to move the cable in the second direction.

17. An exercise apparatus comprising:

a resistance disk including an aperture for receiving a non-rotative spindle therethrough for rotation of the resistance disk on the non-rotative spindle;

a pair of brake disk pads fixedly coupled to the spindle for non-rotation therewith on opposite sides of the resistance disk, the resistance disk rotatable on the spindle when the spindle is received in the resistance disk aperture such that the pair of brake disk pads frictionally oppose rotation of the resistance disk on the spindle; and a universal frame assembly coupled between the resistance disk and a stationary or moveable object, said universal frame assembly defining at least two independent axes about which the resistance disk is rotatable with respect to an axis of the object, wherein the universal frame assembly includes:

a T-arm including a first section and a second, transverse section, wherein the first section of the T-arm is rotatable about the axis of the object, and the second section of the T-arm is rotatable about an axis of the first section of the T-arm during rotation of the first section of the T-arm about the axis of the object;

an elbow having a first end and a second end that faces in a direction transverse to the first end, wherein the first end of the elbow is coupled for rotation with the second section of the T-arm; and a sleeve having first and second ends, the first end of the sleeve coupled for rotation with the second end of the elbow, wherein the non-rotative spindle is fixedly coupled to the second end of the sleeve.

* * * * *